US005508161A

United States Patent [19]

Miyake et al.

[11] Patent Number: 5,508,161

[45] Date of Patent: Apr. 16, 1996

[54] PHOTOGRAPHIC SILVER HALIDE PHOTOSENSITIVE MATERIAL

[75] Inventors: Kiyoteru Miyake; Takashi Kato; Yoshio Inagaki, all of Kanagawa, Japan

[73] Assignee: Fuji Photo Film Co., Ltd., Kanagawa, Japan

[21] Appl. No.: 264,751

[22] Filed: Jun. 23, 1994

Related U.S. Application Data

[63] Continuation of Ser. No. 40,098, Mar. 30, 1993, abandoned.

[30] Foreign Application Priority Data

Mar. 30, 1992 [JP] Japan ..... 4-103504

[51] Int. Cl.[6] ..... G03C 1/10

[52] U.S. Cl. ..... 430/574; 430/584; 430/944

[58] Field of Search ..... 430/574, 584, 430/944

[56] References Cited

U.S. PATENT DOCUMENTS

| | | | |
|---|---|---|---|
| 2,481,022 | 9/1949 | Kendall et al. | 430/594 |
| 4,619,892 | 10/1986 | Simpson et al. | 430/505 |
| 5,013,642 | 5/1991 | Muenter et al. | 430/574 |
| 5,175,080 | 12/1992 | Hioki | 430/584 |
| 5,296,343 | 3/1994 | Hioki et al. | 430/584 |

FOREIGN PATENT DOCUMENTS

| | | | |
|---|---|---|---|
| 069596 | 1/1983 | European Pat. Off. | 430/584 |
| 402087 | 12/1990 | European Pat. Off. | 430/944 |
| 472004 | 2/1992 | European Pat. Off. | 430/574 |

OTHER PUBLICATIONS

Spectral Sensitization of Thermally Processed Silver Film by Cyanine Dyes, Journal of Imaging Science 33: 124–129 (1988).

*Primary Examiner*—Janet C. Baxter

*Attorney, Agent, or Firm*—Sughrue, Mion, Zinn, Macpeak & Seas

[57] ABSTRACT

A photographic silver halide photosensitive material includes an infrared sensitive layer which is spectrally sensitized with a combination of at least two J-band type sensitizing dyes so as to have maximum spectral sensitivity at 700 nm or longer wavelength. The photosensitive material has high sensitivity to exposure to a semiconductor laser of 700 nm or longer wavelength. Color separation is improved in the case of color photosensitive material.

4 Claims, No Drawings

PHOTOGRAPHIC SILVER HALIDE PHOTOSENSITIVE MATERIAL

This is a continuation of application Ser. No. 08/040,098 filed Mar. 30, 1993, now abandoned.

TECHNICAL FIELD

This invention relates to a photographic silver halide photosensitive material which is often simply referred to as photosensitive material, hereinafter. More particularly, it relates to a multilayer color photosensitive material which is adapted to be exposed to a light source in the form of a semiconductor laser emitting radiation in the near infrared to infrared region, has high sensitivity, and can form a color image with a high degree of color separation. In addition to the color photosensitive material, photographic silver halide photosensitive materials characterized by high sensitivity are also contemplated.

BACKGROUND OF THE INVENTION

A new system has been developed in accordance with the recent advances of information processing, information storage and image processing technologies as well as the spreading utilization of communications circuits. It is a technique of producing hard copies from soft information involving photoelectric conversion of electrical signals onto photosensitive material, thereby reproducing image information given in the form of a photograph, characters or numerals into a visible image.

This new system is commercially utilized in a variety of applications including facsimile, computer-aided phototype setting system, characer composing system, scanner dot image formation, holography, and IC photomask.

Equipment for these rapid information transmitting systems include light sources which are often xenon flash lamps, glow discharge lamps, arc lamps, high-pressure mercury lamps, xenon lamps, cathode ray tubes providing flying spots in their phosphor, light emitting diodes (LED) and lasers. Any of these high illuminance light sources is combined with a high speed shutter to provide a light source assembly.

On the other hand, with the advances of both photographic silver halide photosensitive material and a compact, simple, rapid development system which is known as a mini-labo system, photographic prints of high image quality are readily available at low cost. There is a strong demand for producing hard copies from soft information sources in a simple inexpensive manner while retaining an image quality equivalent to photographic prints.

Prior art means for producing hard copies from soft information sources are generally classified into two, one means not relying on photosensitive recording materials, such as systems using electrical and electromagnetic signals and ink jet printing systems and another means using photosensitive materials such as silver halide photosensitive materials and electrophotographic materials. The latter is a recording means using an optical system which is controlled in accordance with image information to emit radiation while the optical system itself is advantageous for providing high image quality because of resolving power, binary recording and multi-gradation recording. As compared with the system using electrophotographic material, the system using photographic silver halide photosensitive material is advantageous because of chemical image formation. The system using photographic silver halide photosensitive material, however, requires deliberate efforts in establishing or optimizing the sensitive wavelength compatible with the optical system, stability of sensitivity, stability of latent images, resolving power, color separation of three primary colors, rapidness and ease of color development, and cost.

Prior art color duplicating techniques include duplicating machines and laser printers based on the electrophotographic technology, dye diffusion systems using heat-developable silver halide material, and Pictrography (trade name of Fuji Photo-Film Co., Ltd.) using LED.

Heat-developable photosensitive material is well known in the art. The heat-developable photosensitive material and its process are described in the literature and patents, for example, "Shasinkougaku No Kiso —Higinen Shasin—" ("Fundamentals of Photographic Engineering —Non-Silver Salt Photography—"), 1982, Corona Publishing K. K., pages 242–255 and U.S. Pat. No. 4,500,626 which is incorporated herein by reference. In addition, U.S. Pat. Nos. 3,761,270 and 4,021,240 disclose a method of forming dye images through coupling reaction with an oxidant of a developing agent. U.S. Pat. No. 4,235,957 discloses a method of forming positive color images by a photosensitive silver dye bleaching technique.

It was also proposed to imagewise release or form a diffusible dye through heat development and transfer the dye to a dye fixing element. With this technique, either negative or positive dye images can be obtained by selecting a suitable type of dye-providing compound or a suitable type of silver halide. For detail, reference is made to U.S. Pat. Nos. 4,500,626, 4,483,914, 4,503,137, 4,559,290; Japanese Patent Application Kokai (JP-A) Nos. 149046/1983, 218443/1984, 133449/1985, and 238056/1986; EP 210660 A2 and 220746 A2; Japan Invention Society's Kokai Giho (Technical Report) No. 87-6199 and the like.

A variety of proposals have been made in the art for producing positive color images through heat development. For example, U.S. Pat. No. 4,559,290 proposes a method for forming an image by converting a dye providing (DRR) compound into an oxidized form having no dye releasing ability, preparing a heat-developable material in which the oxidized DRR compound is co-present with a reducing agent or a precursor thereof, carrying out heat development to oxidize the reducing agent in an amount corresponding to the exposure of silver halide, and allowing the remainder of the reducing agent unoxidized to reduce the oxidized DRR compound into the DRR compound to release a diffusible dye. EP 220746 A2 and Technical Report No. 87-6199 (Vol. 12, No. 22) describe a compound capable of releasing a diffusible dye through a similar mechanism, more particularly a heat-developable color photosensitive material using a compound capable of releasing a diffusible dye through reductive cleavage of an N-X linkage where X is an oxygen, nitrogen or sulfur atom.

Conventional color photosensitive materials generally have spectral sensitization in blue, green and red. In order to produce images in such color photosensitive materials from the image information which has been converted into electrical signals, color cathode ray tubes (CRT) are generally used as an exposure light source. Unfortunately, CRTs are inadequate to produce large size prints.

Also light emitting diodes (LED) and semiconductor lasers (LD) have been developed as the write-in head capable of producing large size prints. However, none of the optical write-in heads ever developed can efficiently emit blue light. Thus in the case of light emitting diodes (LED), for example, a light source in the form of a set of three light emitting diodes of near-infrared (800 nm), red (670 nm) and yellow (570 nm) must be used for exposure of a color photosensitive material having three layers which are spectrally sensitized in near-infrared, red and yellow. One image recording system of such construction is described in Nikkei New Material, Sep. 14, 1987, pp. 47–57 and some are used in commercial application.

Similarly, a system including a light source in the form of a set of three semiconductor lasers of 880 nm, 820 nm and 760 nm light emission for recording images in a color photosensitive material having three photosensitive layers which are sensitive to the respective wavelengths is described in JP-A 137149/1986.

In general, when the colors of yellow, magenta and cyan are generated in a multilayer color photosensitive material by exposure to three different spectra, it is of importance for color reproduction to generate the respective colors without amalgamation. Particularly when light emitting diodes (LED) and semiconductor lasers (LD) are used as the exposure light source, the photosensitive material must be designed to have three spectral sensitivities in spectra within the narrow range between the red end and the infrared region. It is a key for improving color separation to reduce the overlap between the respective spectral sensitivities as much as possible.

Since the sensitizing dyes of the near-infrared to infrared region which have been heretofore used are very broad in spectral sensitivity, there is a likelihood for their spectral sensitivities to overlap one another, leading to poor color separation.

To insure color separation, attempts were made to sequentially increase the sensitivity from a shorter wavelength side or to provide filter layers as described in U.S. Pat. No. 4,619,892. However, the sequential increase of sensitivity can invite increased fog and adversely affect raw stock stability. In addition, the infrared sensitization is known to inherently deteriorate the raw stock stability of photosensitive material. There is a need for a photosensitive material having sharp spectral sensitivity and high sensitivity in the infrared region.

For sharp spectral sensitivity, a choice of the spectral sensitivity peak wavelength becomes more important than in the case of broad spectral sensitivity. This means that to provide higher sensitivity, the spectral sensitivity peak wavelength must be set near the light emission wavelength of a semiconductor laser or light emitting diode.

During operation, the semiconductor lasers experience an intensity lowering or droop accompanied by ah increase of the light emission wavelength due to self heat generation. In the event of sharp spectral sensitivity, if the spectral sensitivity peak wavelength is shorter than the light emission wavelength of the semiconductor laser, then a lowering of density upon delivery of image outputs due to the droop is considerably expanded. Therefore, the spectral sensitivity peak wavelength must be set longer than the light emission wavelength of the semiconductor laser for compensating for the density lowering due to the droop. In the event of sharp spectral sensitivity, control of the peak wavelength is thus a very important problem in the design of photosensitive material.

There is a need to have a photographic silver halide photosensitive material having sharp spectral sensitivity and high sensitivity in the infrared region.

SUMMARY OF THE INVENTION

Therefore, an object of the present invention is to provide a photographic silver halide photosensitive material having high sensitivity to the radiation of a semiconductor laser having a wavelength of 700 nm or longer.

Another object of the present invention is to provide a color photographic silver halide photosensitive material which has such high sensitivity and is improved in color separation.

The present invention is directed to a photographic silver halide photosensitive material comprising at least one infrared sensitive layer. The infrared sensitive layer contains at least two J-band type sensitizing dyes in combination whereby the layer is spectrally sensitized so as to have maximum spectral sensitivity at a wavelength of at least 700 nm.

Preferably, the J-band type sensitizing dye is a compound of formula (1):

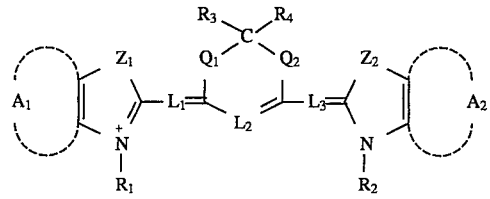

(1)

$(M_1)_{m1}$ wherein $Z_1$ and $Z_2$ each are a sulfur or selenium atom, $Q_1$ and $Q_2$ each are a methylene radical, $R_1$ and $R_2$ each are an alkyl radical, $R_3$ and $R_4$ are independently selected from the group consisting of a hydrogen atom, alkyl radical, aryl radical, and heterocyclic radical, $L_1$, $L_2$ and $L_3$ each are a methine radical, $R_1$ and $L_1$, and $R_2$ and $L_3$, taken together, may form a ring, $A_1$ and $A_2$ each are a group of atoms necessary to form a benzene ring, $M_1$ is an electric charge balancing counter ion, and $m_1$ has a value necessary to neutralize the electric charge.

More preferably, the layer contains as the combined J-band type sensitizing dyes at least one compound of formula (2) and at least one compound of formula (3).

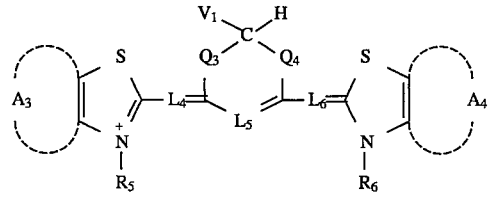

(2)

$(M_2)_{m2}$

In formula (2), $Q_3$ and $Q_4$ each are a methylene radical, $R_5$ and $R_6$ each are an alkyl radical, $V_1$ is an aryl radical or heterocyclic radical, $L_4$, $L_5$ and $L_6$ each are a methine radical, $R_5$ and $L_4$, and $R_6$ and $L_6$, taken together, may form a ring, $A_3$ and $A_4$ each are a group of atoms necessary to form a benzene ring, $M_2$ is an electric charge balancing counter ion, and $m_2$ has a value necessary to neutralize the electric charge.

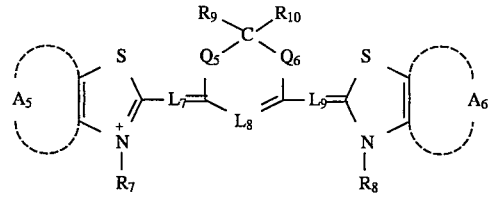

(3)

$(M_3)_{m3}$

In formula (3), $Q_5$ and $Q_6$ each are a methylene radical, $R_7$ and $R_8$ each are an alkyl radical, $R_9$ and $R_{10}$ are independently selected from the group consisting of a hydrogen atom, alkyl radical, aryl radical, and heterocyclic radical, $L_7$, $L_8$ and $L_9$ each are a methine radical, $R_7$ and $L_7$, and $R_8$ and $L_9$, taken together, may form a ring, $A_5$ and $A_6$ each are a group of atoms necessary to form a benzene ring, $M_3$ is an electric charge balancing counter ion, and m3 has a value necessary to neutralize the electric charge.

DETAILED DESCRIPTION OF THE INVENTION

The photographic silver halide photosensitive material of the present invention is defined as comprising at least one infrared sensitive layer which is to be exposed to a light source in the form of a semiconductor laser capable of emitting light in the near-infrared to infrared region. At least one layer of these infrared sensitive layers is spectrally sensitized with a combination of at least two J-band type sensitizing dyes so that the layer may have maximum spectral sensitivity at a wavelength of 700 nm or longer.

By the term J-band type sensitizing dye is meant a sensitizing dye capable of forming a band (known as a J-band) having a maximum absorption peak at a wavelength longer by at least 30 nm than the maximum absorption peak of the Ma band. The terms Ma and J bands are described in T. H. James, The Theory of the Photographic Process, Fourth Edition, Macmillan, 1977, pp. 235. The Ma band refers to absorption of an adsorbed sensitizing dye in a monomeric unperturbed state whereas the J band refers to absorption of the dye in a polymeric perturbed state.

The sensitizing dyes used in the photosensitive layer are those among the above-defined J-band type sensitizing dyes which have maximum absorption wavelengths of 700 nm or longer. By using at least two J-band type sensitizing dyes in a single emulsion layer, sensitivity can be enhanced, and color separation can be improved in the event of color photosensitive material. These benefits are obtained only when two or more J-band type sensitizing dyes are combined, but not achieved when J-band type sensitizing dyes are used singly, when infrared sensitizing dyes of another type are used singly or in admixture, or when J-band type sensitizing dyes are used in combination with infrared sensitizing dyes of another type.

Among the J-band type sensitizing dyes, many dyes having maximum absorption wavelengths in the visible region are known as described, for example, in T. H. James, The Theory of the Photographic Process, Fourth Edition, Macmillan, 1977, pp. 218–222. But, regarding the J-band type sensitizing dyes having a maximum absorption wavelength of 700 nm or longer, only a few examples are known. H. Kampfer, Proceedings of the International Congress of Photographic Science Koln (Cologue), 1986, pp. 366 reports sensitizing dyes forming J-aggregates at wavelengths of 750 nm or longer, without referring to their photographic performance.

Making extensive investigations on J-band type sensitizing dyes having a maximum absorption wavelength of 700 nm or longer, the inventors have reached the present invention.

Prior to the present invention, the inventors proposed the single use of J-band type sensitizing dyes in Japanese Patent Application Nos. 138613/1991, 311498/1991, 231018/1991 and 261389/1991, which provide improvements in color separation, sensitivity and raw stock storability over the prior art. Nevertheless, further improvement in sensitivity is desired and the present invention satisfies such a demand.

Preferred J-band type infrared sensitizing dyes used herein are of formula (1).

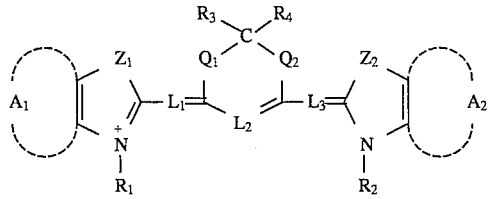

$(M_1)_{m1}$

In formula (1), $Z_1$ and $Z_2$ are independently sulfur or selenium atoms, preferably sulfur atoms.

$Q_1$ and $Q_2$ are independently substituted or unsubstituted methylene radicals. The substituents on the methylene include carboxy radicals, sulfo radicals, cyano radicals, halogen atoms (e.g., fluorine, chlorine and bromine), hydroxy radicals, alkoxycarbonyl radicals having up to 8 carbon atoms (e.g., methoxycarbonyl, ethoxycarbonyl and benzyloxycarbonyl), aryloxycarbonyl radicals (e.g., phenoxycarbonyl), alkoxy radicals having up to 8 carbon atoms (e.g., methoxy, ethoxy, benzyloxy and phenethyloxy), monocyclic aryloxy radicals having up to 15 carbon atoms (e.g., phenoxy and p-tolyloxy), acyloxy radicals having up to 8 carbon atoms (e.g., acetyloxy and propionyloxy), acyl radicals having up to 8 carbon atoms (e.g., acetyl, propionyl and benzoyl), carbamoyl radicals (e.g., carbamoyl, N,N-dimethylcarbamoyl, morpholinocarbonyl and piperidinocarbonyl), sulfamoyl radicals (e.g., sulfamoyl, N,N-dimethylsulfamoyl, morpholinosulfonyl and piperidinosulfonyl), aryl radicals having up to 15 carbon atoms (e.g., phenyl, 4-chlorophenyl, 4-methylphenyl and α-naphthyl). Preferred is an unsubstituted methylene radical.

$R_1$ and $R_2$ are independently alkyl radicals, preferably substituted or unsubstituted alkyl radicals having up to 18 carbon atoms. Exemplary alkyl radicals are methyl, ethyl, propyl, butyl, pentyl, octyl, decyl, dodecyl and octadecyl radicals. The substituents on these alkyl radicals include carboxy radicals, sulfo radicals, cyano radicals, halogen atoms (e.g., fluorine, chlorine and bromine), hydroxy radicals, alkoxycarbonyl radicals having up to 8 carbon atoms (e.g., methoxycarbonyl, ethoxycarbonyl and benzyloxycarbonyl), aryloxycarbonyl radicals (e.g., phenoxycarbonyl), alkoxy radicals having up to 8 carbon atoms (e.g., methoxy, ethoxy, benzyloxy, phenethyloxy), monocyclic aryloxy radicals having up to 10 carbon atoms (e.g., phenoxy and p-tolyloxy), acyloxy radicals having up to 3 carbon atoms (e.g., acetyloxy and propionyloxy), acyl radicals having up to 8 carbon atoms (e.g., acetyl, propionyl, benzoyl and mesyl), carbamoyl radicals (e.g., carbamoyl, N,N-dimethylcarbamoyl, morpholinocarbonyl and piperidinocarbonyl), sulfamoyl radicals (e.g., sulfamoyl, N,N-dimethylsulfamoyl, morpholinosulfonyl and piperidinosulfonyl), aryl radicals having up to 10 carbon atoms (e.g., phenyl, 4-chlorophenyl, 4-methylphenyl and α-naphthyl). $R_1$ and $L_1$, and $R_2$ and $L_3$, taken together, may form a ring. Then these radicals are preferably carbon atoms forming an unsubstituted 5-, 6- or 7-membered ring, especially a 6-membered ring.

Preferably, $R_1$ and $R_2$ are unsubstituted alkyl radicals having up to 18 carbon atoms such as methyl, ethyl, n-propyl and n-butyl radicals; substituted alkyl radicals having up to 18 carbon atoms such as methoxyethyl, phenoxyethyl and methylthioethyl radicals, carboxyalkyl radicals (e.g., 2-carboxyethyl and carboxymethyl radicals), sulfoalkyl radicals (e.g., 2-sulfoethyl, 3-sulfopropyl, 4-osulfobutyl and 3-sulfobutyl radicals), and $R_1$ and $L_1$, and $R_2$ and $L_3$, taken together, form a ring.

Most preferably, $R_1$ and $R_2$ are identical and unsubstituted alkyl radicals such as methyl and ethyl radicals or substituted alkyl radicals such as methoxyethyl and phenoxyethyl radicals.

$R_3$ and $R_4$ are independently selected from the group consisting of a hydrogen atom, alkyl radical, aryl radical, and heterocyclic radical. The alkyl radicals are either substituted or unsubstituted ones. Preferred are unsubstituted alkyl radicals having 1 to 18 carbon atoms, more preferably 1 to 7 carbon atoms, most preferably 1 to 4 carbon atoms, for example, such as methyl, ethyl, propyl, isopropyl, butyl, isobutyl, hexyl, octyl, dodecyl and octadecyl radicals. Also preferred are substituted alkyl radicals, for example, aralkyl radicals (e.g., benzyl and 2 -phenylethyl radicals), hydroxyalkyl radicals (e.g., 2-hydroxyethyl and 3-hydroxypropyl radicals), carboxyalkyl radicals (e.g., 2-carboxyethyl, 3ocarboxypropyl, 4-carboxybutyl and carboxymethyl radicals), alkoxyalkyl radicals (e.g., 2-methoxyethyl and 2-(2-methoxyethoxy) ethyl radicals), sulfoalkyl radicals (e.g., 2-sulfoethyl, 3-sulfopropyl, 3-sulfobutyl, 4-sulfobutyl, 2-(3-sulfopropoxy)ethyl, 2-hydroxy-3-sulfopropyl and 3-sulfopropoxyethoxyethyl radicals), sulfatoalkyl radicals (e.g., 3-sulfatopropyl and 4-sulfatobutyl radicals), heterocyclically substituted alkyl radicals (e.g., 2-(pyrrolidin-2-on-1-yl)ethyl, tetrahydrofurfuryl and 2-morpholinoethyl radicals), 2-acetoxyethyl, carbomethoxymethyl and 2-methanesulfonylaminoethyl radicals.

The aryl radicals are either substituted or unsubstituted ones. Preferred unsubstituted aryl radicals are, for example, phenyl, 2-naphthyl, and 1-naphthyl radicals. Preferred substituted aryl radicals are, for example, 4-carboxyphenyl, 4-sulfophenyl, 3-chlorophenyl, and 3-methylphenyl radicals.

The heterocyclic radicals are either substituted or unsubstituted ones. Preferred unsubstituted heterocyclic radicals are, for example, 2-pyridyl, 2-thiazolyl, 2-furyl and 2-thiophenyl radicals. Preferred substituted heterocyclic radicals are, for example, 4-methyl-2-pyridyl and 4-phenyl-2-thiazolyl radicals.

Preferably, $R_3$ and $R_4$ are hydrogen atoms, substituted or unsubstituted alkyl radicals (wherein the substituents are alkoxy and aryl radicals), and substituted or unsubstituted aryl radicals (wherein the substituents are alkoxy radicals and halogen atoms). Most preferably, $R_3$ and $R_4$ are hydrogen atoms, unsubstituted alkyl radicals such as methyl and ethyl radicals, and unsubstituted aryl radicals such as phenyl and 1-naphthyl radicals.

In the preferred combinations of $R_3$ and $R_4$, both $R_3$ and $R_4$ are alkyl radicals, or $R_3$=H and $R_4$ is an alkyl, aryl or heterocyclic radical. Most preferably, $R_3$=$R_4$=methyl radical, or $R_3$=H and $R_4$ is a methyl, ethyl or phenyl radical.

$L_1$, $L_2$ and $L_3$ are independently substituted or unsubstituted methine radicals. The substituents on the methine include substituted or unsubstituted alkyl radicals (e.g., methyl, ethyl and 2-carboxyethyl radicals), substituted or unsubstituted aryl radicals (e.g., phenyl and o-carboxyphenyl radicals), halogen atoms (e.g., chlorine and bromine atoms), and alkoxy radicals (e.g., methoxy and ethoxy radicals). $L_1$ and $L_3$ may form a ring with an auxochrome.

Preferably, $L_1$, $L_2$ and $L_3$ are unsubstituted methine radicals, or $L_1$ and $L_3$ are unsubstituted methine radicals and only $L_2$ is an alkyl-substituted methine radical with the alkyl substituents being preferably methyl and ethyl radicals.

$A_1$ and $A_2$ each are a group of atoms necessary to form a benzene ring which may be either substituted or unsubstituted. The substituents on the benzene ring include halogen atoms (e.g., fluorine, chlorine and bromine), unsubstituted alkyl radicals having up to 10 carbon atoms (e.g., methyl and ethyl), substituted alkyl radicals having up to 18 carbon atoms (e.g., benzyl, α-naphthyl, 2-phenylethyl and trifluoromethyl), acyl radicals having up to 8 carbon atoms (e.g., acetyl and benzoyl), acyloxy radicals having up to 8 carbon atoms (e.g., acetyloxy), alkoxy-carbonyl radicals having up to 8 carbon atoms (e.g., methoxycarbonyl, ethoxycarbonyl and benzyloxycarbonyl), carbamoyl radicals (e.g., carbamoyl, N,N-dimethylcarbamoyl, morpholinocarbonyl and piperidinocarbonyl), sulfamoyl radicals (e.g., sulfamoyl, N,N-dimethylsulfamoyl, morpholinosulfonyl and piperidinosulfonyl), a carboxy radical, a cyano radical, a hydroxy radical, an amino radical, acylamino radicals having up to 8 carbon atoms (e.g., acetylamino), sulfonamido radicals having up to 8 carbon atoms (e.g., benzenesulfonamido), alkoxy radicals having up to 10 carbon atoms (e.g., methoxy, ethoxy and benzyloxy), alkylthio radicals having up to 10 carbon atoms (e.g., ethylthio), alkylsulfonyl radicals having up to 5 carbon atoms (e.g., methylsulfonyl), a sulfonate radical, and aryl radicals having up to 15 carbon atoms (e.g., phenyl and tolyl).

Two substituents attached to two adjacent carbon atoms in each of the benzene rings formed by $A_1$ and $A_2$ may be taken together to form a benzene ring or a heterocyclic ring such as pyrole, thiophene, furan, pyridine, imidazole, triazole, and thiazole.

Preferably, $A_1$=$A_2$. More preferably the benzene ring is unsubstituted or substituted with alkyl radicals, alkoxy radicals or halogen atoms at the 5-position thereof.

$M_1$ is an electric charge balancing counter ion, and $m_1$ has a value necessary to neutralize the electric charge. $(M_1)m_1$ is included in the formula for the purpose of indicating the presence or absence of any cation or anion necessary to render the ionic charge of the dye neutral. Whether a certain dye is a cation or an anion or has a net ionic charge depends on the auxochrome and substituent. Typical cations are inorganic or organic ammonium ions and alkali metal ions. The anions may be either inorganic or organic anions, for example, halide anions (e.g., fluoride, chloride, bromide and iodide ions), substituted arylsulfonate ions (e.g., p-toluenesulfonate and p-chlorobenzenesulfonate ions), aryldisulfonate ions (e.g., 1,3-benzenedisulfonate, 1,5-naphthalenedisulfonate, and 2,6-naphthalenedisulfonate ions), alkylsulfate ions (e.g., methylsulfate ion), sulfate ion, thiocyanate ion, perchlorate ion, tetrafluoroborate ion, pictate ion, acetate ion, and trifluoromethanesulfonate ion. Preferred are ammonium, halide, p-toluenesulfonate and sulfate ions.

According to the present invention, at least two of the sensitizing dyes of formula (1) are used in combination. Preferred is a combination of a sensitizing dye of formula (2) and a sensitizing dye of formula (3).

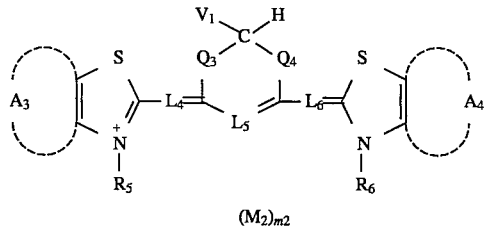

(2)

In formula (2), $Q_3$, $Q_4$, $R_5$, $R_6$, $L_4$, $L_5$, $L_6$, $A_3$, $A_4$, $M_2$, and $m_2$ are as defined for $Q_1$, $Q_2$, $R_1$, $R_2$, $L_1$, $L_2$, $L_3$, $A_1$, $A_2$, $M_1$, and $m_1$ in formula (1), respectively.

$V_1$ is selected from unsubstituted aryl radicals (e.g., phenyl, 1-naphthyl and 2-naphthyl radicals), substituted aryl radicals (e.g., 4-chlorophenyl, 4-methylphenyl, 4-methoxyphenyl, 4-methylthiophenyl, 3-hydroxyphenyl, 4-carboxyphenyl and 4-sulfophenyl radicals), unsubstituted heterocyclic radicals (e.g., 2-pyridyl, 3-pyridyl, 2-furyl and 2-thiophenyl radicals), and substituted heterocyclic radicals (e.g., 4-methyl-2-pyridyl and 4-phenyl-2-thiazolyl radicals). Preferably, $V_1$ is a substituted or unsubstituted aryl radical, most preferably a phenyl radical.

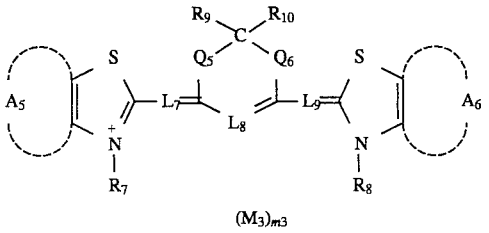

(3)

In formula (3), $Q_5$, $Q_6$, $R_7$, $R_8$, $R_9$, $R_{10}$, $L_7$, $L_8$, $L_9$, $A_5$, $A_6$, $M_3$ and $m_3$ are as defined for $Q_1$, $Q_2$, $R_1$, $R_2$, $R_3$, $R_4$, $L_1$, $L_2$, $L_3$, $A_1$, $A_2$, $M_1$ and $m_1$ in formula (1), respectively.

Several illustrative, non-limiting examples of the sensitizing dye of formula (1) are given below by general formulae (D I) and (D II). It is to be noted that the preferred sensitizing dyes used herein are described in Japanese Patent Application Nos. 270161/1990, 231018/1991, and 261389/1991 by the same assignee or applicant as the present invention. The general formula (D I) is a preferred form of formula (2) and the following list shows preferred combinations of $R^1$, $R^2$, and other substituents. The general formula (D II) is a preferred form of formula (3) and the following list shows preferred combinations of $R^{11}$, $R^{12}$, and other substituents. Ph is phenyl and $PTS^-$ is a p-toluenesulfonate ion.

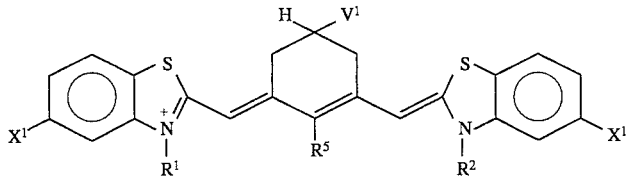

$(M^1)_{m1}$

| | $R^1$ | $R^2$ | $R^5$ | $V^1$ | $X^1$ | $M^1$ | $m^1$ |
|---|---|---|---|---|---|---|---|
| DI-1 | $C_2H_5$ | $C_2H_5$ | H | 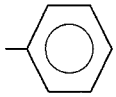 | H | $I^-$ | 1 |
| DI-2 | " | " | H | 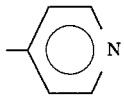 | H | $I^-$ | 1 |
| DI-3 | " | " | $CH_3$ | 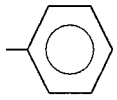 | H | $I^-$ | 1 |
| DI-4 | $C_2H_5$ | $(CH_2)_3SO_3^-$ | H | 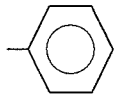 | H | — | — |
| DI-5 | $C_2H_4OCH_3$ | $C_2H_4OCH_3$ | H | 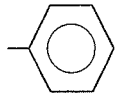 | H | $I^-$ | 1 |
| DI-6 | $C_2H_4OPh$ | $C_2H_4OPh$ | H | 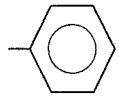 | H | $I^-$ | 1 |
| DI-7 | $C_2H_5$ | $C_2H_5$ | H | 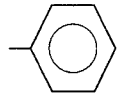 | H | $Br^-$ | 1 |
| DI-8 | $C_2H_5$ | $C_2H_5$ | H | " | H | 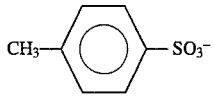 | 1 |

-continued

| | | | | | | | |
|---|---|---|---|---|---|---|---|
| DI-9 | $C_2H_4OCH_3$ | $C_2H_4OCH_3$ | H | " | H | " | " |
| DI-10 | $C_2H_4OCH_3$ | $C_2H_4OCH_3$ | $CH_3$ | " | H | $I^-$ | 1 |
| DI-11 | $C_2H_5$ | $C_2H_5$ | H | 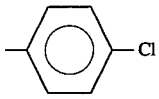 | H | $I^-$ | −1 |
| DI-12 | $(CH_2)_3SO_3^-$ | $(CH_2)_3SO_3^-$ | H | 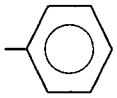 | H | $Na^+$ | 1 |
| DI-13 | $C_2H_5$ | $(CH_2)_2SO_3^-$ | $C_2H_5$ | 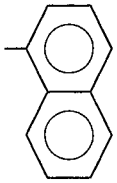 | H | — | — |
| DI-14 | $C_2H_5$ | $C_2H_5$ | H | 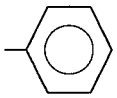 | $OCH_3$ | $I^-$ | 1 |
| DI-15 | " | " | " | " | $CH_3$ | $I^-$ | 1 |
| DI-16 | " | " | " | " | $OCH_3$ | $I^-$ | 1 |
| DI-17 | " | " | " | " | Cl | $I^-$ | 1 |
| DI-18 | " | " | $CH_3$ | " | $OC_2H_5$ | $I^-$ | 1 |
| DI-19 | " | " | $CH_3$ | " | $OCH_3$ | $I^-$ | 1 |
| DI-20 | " | " | H | " | OH | 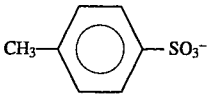 | 1 |
| DI-21 | $(CH_2)_2SO_3^-$ | $(CH_2)_2SO_3^-$ | H | " | $OCH_3$ | $HN(C_2H_5)_3^+$ | 1 |
| DI-22 | $C_2H_5$ | $(CH_2)_2SO_3^-$ | H | " | $CH_3$ | — | 1 |
| DI-23 | $C_2H_5$ | $C_2H_5$ | " | " | Cl | $ClO_4^-$ | 1 |
| DI-24 | $C_2H_4OCH_3$ | $C_2H_5$ | H | 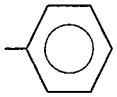 | H | $I^-$ | 1 |
| DI-25 | $C_2H_4OCH_3$ | $C_2H_5$ | H | 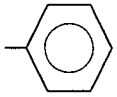 | $OCH_3$ | $ClO_4^-$ | 1 |

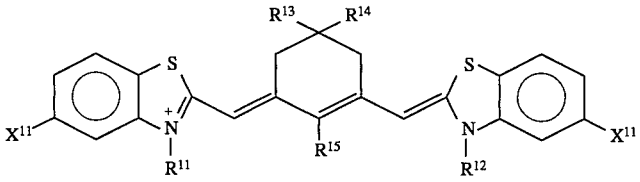

$(M^{11})_{m11}$

| | $R^{11}$ | $R^{12}$ | $R^{13}$ | $R^{14}$ | $R^{15}$ | $X^{11}$ | $M^{11}$ | $m^{11}$ |
|---|---|---|---|---|---|---|---|---|
| DII-1 | $C_2H_5$ | $C_2H_5$ | H | $CH_3$ | H | H | $I^-$ | 1 |
| DII-2 | " | " | $CH_3$ | $CH_3$ | H | " | $I^-$ | 1 |
| DII-3 | " | " | H | $C_2H_5$ | H | " | $I^-$ | 1 |
| DII-4 | " | " | H | $CH_3$ | H | " | $Br^-$ | 1 |
| DII-5 | " | " | H | $CH_3$ | $CH_3$ | " | $I^-$ | 1 |
| DII-6 | $C_2H_4OCH_3$ | $C_2H_4OCH_3$ | H | $CH_3$ | H | " | $I^-$ | 1 |
| DII-7 | " | " | " | " | " | " | 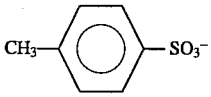 | 1 |
| DII-8 | " | " | " | " | $CH_3$ | " | $I^-$ | 1 |

-continued

| | | | | | | | | |
|---|---|---|---|---|---|---|---|---|
| DII-9 | $C_2H_4OPh$ | $C_2H_4OPh$ | H | $CH_3$ | H | " | $I^-$ | " |
| DII-10 | $C_2H_4OCH_3$ | $C_2H_4OCH_3$ | $CH_3$ | $CH_3$ | H | " | $I^-$ | 1 |
| DII-11 | $C_2H_5$ | $(CH_2)_3SO_3^-$ | H | $CH_3$ | H | H | — | — |
| DII-12 | $C_2H_5$ | $C_2H_5$ | $CH_3$ | $CH_3$ | 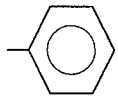 | " | $Cl^-$ | 1 |
| DII-13 | $C_2H_5$ | $C_2H_5$ | $CH_3$ | 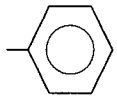 | H | " | $I^-$ | 1 |
| DII-14 | $C_2H_5$ | $C_2H_5$ | H | $CH_3$ | $C_2H_5$ | " | $I^-$ | 1 |
| DII-15 | " | " | " | " | H | " | $Na^+$ | 1 |
| DII-16 | " | " | " | " | $CH_3$ | $OCH_3$ | $PTS^-$ | 1 |
| DII-17 | " | " | " | " | $CH_3$ | $OC_2H_5$ | $I^-$ | 1 |
| DII-18 | " | " | $CH_3$ | " | H | Cl | $ClO_4^-$ | 1 |
| DII-19 | " | " | " | " | H | $CH_3$ | $I^-$ | 1 |
| DII-20 | " | " | H | $CH_3$ | " | $OCH_3$ | $I^-$ | 1 |
| DII-21 | $(CH_2)_3SO_3^-$ | $(CH_2)_3SO_3^-$ | H | $CH_3$ | " | " | $HN(C_2H_5)_3^+$ | 1 |
| DII-22 | $C_2H_5$ | $C_2H_5$ | H | $CH_3$ | " | Cl | $I^-$ | 1 |
| DII-23 | $C_2H_5$ | $C_2H_5$ | H | $C_2H_5$ | " | $CH_3$ | 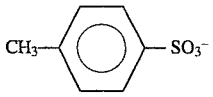 | 1 |
| DII-24 | $C_2H_5$ | $C_2H_5$ | $CH_3$ | $CH_3$ | H | $OCH_3$ | $I^-$ | 1 |
| DII-25 | $C_2H_4OCH_3$ | $C_2H_5$ | H | $CH_3$ | H | H | $I^-$ | 1 |

(1) Combination of sensitizing dye

According to the present invention, at least two of the J-band type sensitizing dyes defined above are used in combination. They are combined such that the dye having the highest proportion is present in a molar fraction of 0.25 to 0.95.

Preferred sensitizing dye combinations are at least one sensitizing dye of formula (D I) combined with at least one sensitizing dye of formula (D II). Differently stated, cationic-cationic, anionic-anionic, betain-betain, cationic-betain, and anionic-betain combinations are preferred, with the cationic-cationic combinations being most preferred.

The combined use of sensitizing dyes of formulae (D I) and (D II) provides sharp spectral sensitivity and high sensitivity. As compared with the single use, the combined use shifts the wavelength of maximum spectral sensitivity toward a longer side. The extent of this wavelength shift is more prominent with a relatively larger proportion of formula (D II) dye to formula (D I) dye, provided that the formula (D I) dye is major. This phenomenon is quite unexpected. Better results are obtained with a molar ratio of formula (D II) dye to formula (D I) dye of from 0.05 to 0.75, especially from 0.1 to 0.5. It is also preferred to use two or more of formula (D I) dyes and/or formula (D II) dyes.

In the case of cationic dyes, the charge balancing counter ion is preferably a Br ion, para-toluenesulfonate ion or Cl ion because the solubility of the dye in solvent is high enough to reduce the amount of entrained solvent (methanol, ethanol, etc.) upon addition of the dye to an emulsion so that the emulsion coating solution may become more stable during storage.

In addition to the J-band type infrared sensitizing dyes, any of other sensitizing dyes may be used in combination. The other sensitizing dyes which can be additionally combined are known from U.S. Pat. No. 4,617,257, JP-A 180550/1984, 140335/1985, and RD 17029 (1978), pages 12–13. Also combinable with the sensitizing dyes in the emulsion are those dyes which themselves have no spectral sensitization capability or compounds which do not substantially absorb visible and/or infrared radiation, but provide supersensitization as described in U.S. Pat. No. 3,615,641 and JP-A 23145/1987.

Preferably the sensitizing dyes are contained in the silver halide emulsion in a total amount of $0.5\times10^{-7}$ to $8\times10^{-3}$ mol per mol of silver halide, more preferably $1\times10^{-7}$ to $5\times10^{-3}$ mol per mol of silver halide, most preferably $2\times10^{-7}$ to $2\times10^{-3}$ mol per mol of silver halide.

The sensitizing dyes used in the photosensitive material of the invention can be synthesized by the methods described in the literature, for example, F. M. Hamer, "Heterocyclic compounds—Cyanine dyes and related compounds", John Wiley & Sons, New York, London, 1964 and D. M. Sturmer, "Heterocyclic compounds—Special topics in heterocyclic chemistry", John Wiley & Sons, New York, London, 1977.

(2) Addition method and stage of sensitizing dye

The sensitizing dyes used in the invention may be used in powder form and mechanically dispersed directly in the emulsion. Alternatively, the dyes may be dissolved in a suitable solvent before addition. The solvents used herein include water-miscible organic solvents such as methyl alcohol, ethyl alcohol, methyl cellosolve, acetone, fluorinated alcohols, dimethylformamide, and propyl alcohol and water (which may be either alkaline or acidic) alone or in admixture of two or more. When such organic solvents as methyl alcohol and ethyl alcohol are used, addition of a surfactant, base or acid is effective for increasing the solubility. This is advantageous to reduce the amount of entrained solvent upon addition of the dyes to an emulsion so that the emulsion coating solution may become more stable during storage. The preferred acid which can be added for such purpose is para-toluenesulfonic acid since it is soluble in methanol and ethanol and eliminates introduction of water into the sensitizing dye solution. The dyes may be added in the form of a dispersion in a gelatin aqueous solution or a freeze dried powder. Further, the dyes may be added in the form of powder dispersed in water with the aid of a surfactant.

With the sensitizing dyes added, the silver halide emulsion is preferably agitated at temperatures of 50 to 85° C. for more than 15 minutes, especially more than 30 minutes. Insofar as such agitation is insured, the sensitizing dyes may be added at any desired stage. More particularly, the sensitizing dyes may be added at the start, intermediate or end of formation of silver halide grains (inclusive of prior to nucleus formation), at the start, intermediate or end of desalting, during redispersion of gelatin, before, during or after chemical sensitization, or during preparation of a coating solution. Preferably, the sensitizing dyes are added during or after formation of silver halide grains, or before, during or after chemical sensitization. The addition after chemical sensitization means that the sensitizing dyes are added after all the chemicals necessary for chemical sensitization have been added. As to the addition method, the dyes may be added all at once, or in several divided portions at the same step or different steps. The dyes may be slowly added over a substantial time, if desired.

Preferably, the amount of sensitizing dyes added is 30 to 150%, more preferably 50 to 100% of the adsorption saturation coverage. The adsorption saturation coverage can be claculated from the molar amount of sensitizing dyes added and the overall surface area of silver halide emulsion grains, provided that the area that one molecule of thiadicarbocyanine dye occupies on the silver halide emulsion grain surface is about 100 square angstrom.

In one embodiment wherein the sensitizing dyes are added before, during or after silver halide grain formation, if grain formation must be carried out at low temperatures below 50° C., then the emulsion should be agitated at 50 to 85° C. for more than 15 minutes in a subsequent step (for example, during chemical sensitization). One recommended procedure is to heat the emulsion to 50° to 85° C. and agitate it for more than 15 minutes before desalting. In the embodiment wherein the sensitizing dyes are added along with silver halide grain formation, the dyes may be added all at once, but preferably slowly or in several divided portions because re-nucleation can otherwise occur during silver halide grain formation.

Two or more sensitizing dyes are preferably added at the same time although they may be added with a time lag of, for example, about 10 minutes. For simultaneous addition, they are preferably added in a solution mix form.

Among gelatin flocculants used in the desalting step as described in JP-A 140322/1983, flocculant (P-2) shown below often inhibits adsorption of sensitizing dyes. Then it is especially preferred to add sensitizing dyes during and/or after silver halide grain formation and before desalting. If it is desired to add sensitizing dyes after desalting (inclusive of during chemical sensitization), then it is preferred to use gelatin flocculants which little inhibit adsorption, for example, flocculant (P-1) shown below. A desalting step using a ultrafiltration means as described in U.S. Pat. No. 4,758,505 is also preferred in view of the adsorption of sensitizing dyes.

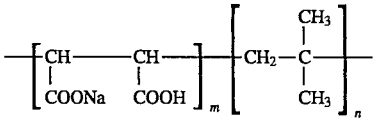

(P-1)

-continued

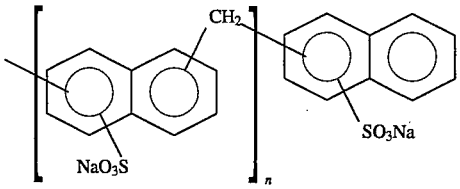

(P-2)

Along with sensitizing dyes, any of soluble calcium, iodine, bromine, chlorine and thiocyanate compounds may be added before, during or after addition of the sensitizing dyes. Preferred compounds are $CaCl_2$, KI, KBr, KCl and KSCN to name a few.

(3) Silver halide grains

The silver halide emulsion used herein may be of silver chloride, silver bromide, silver iodobromide, silver chlorobromide, silver iodochloride, or silver chloroiodobromide. Preferred are silver iodobromide containing less than 10 mol % of silver iodide, silver chloride, silver bromide and silver chlorobromide.

The silver halide emulsions used herein may be either of the surface latent image type or of the internal latent image type. The internal latent image type emulsion is used as a direct reversal emulsion in combination with a nucleating agent or secondary exposure. Also employable are emulsions of multilayer grains having different halogen compositions at the interior and the surface thereof. Among the multilayer grains, the dual-layer grain emulsion is often called a core-shell emulsion.

The silver halide emulsion is preferably monodisperse. It preferably has a coefficient of variation of grain size distribution of up to 20%, more preferably up to 16%, most preferably up to 10%. The coefficient of variation is as defined in JP-A 110555/1991. However, the invention is not limited to the monodisperse emulsion.

Preferably the silver halide grains used herein have a mean grain size of about 0.1 to 2.2 μm, more preferably about 0.1 to 1.2 μm, most preferably about 0.1 to 0.8 μm. The crystal habit of silver halide grains may be of a cubic, octahedral, or plate shape having a high aspect ratio or potato shape, but is not limited thereto.

More illustratively, use may be made of any of the silver halide emulsions described in U.S. Pat. No. 4,500,626, col. 50, U.S. Pat. No. 4,628,021, RD 17029 (1978), and JP-A 25159/1987.

The preparation of a silver halide emulsion according to the present invention generally includes a desalting step for removing the excess salt. The desalting step may be by the old well-known noodle washing method of gelling gelatin or by flocculation methods using inorganic salts of polyvalent anions, for example, sodium sulfate, anionic surfactants, anionic polymers (e.g., polystyrenesulfonic acid), and gelatin derivatives (e.g., aliphatic acylated gelatin, aromatic acylated gelatin, and aromatic carbamoylated gelatin). A flocculation method using the aforementioned flocculant (P-1) is preferred although the invention is not limited thereto. The excess salt removal may be omitted in some cases. Alternatively, excess salt may be removed by ultrafiltration means as disclosed in U.S. Pat. Nos. 4,758,505 and 4,334,012, JP-A 113137/1987, and JP-B 43727/1984.

In the silver halide emulsion used herein may be contained heavy metals such as iridium, rhodium, platinum, cadmium, zinc, thallium, lead, iron, chromium, ruthenium, rhenium, etc. These heavy metal compounds may be used alone or in admixture of two or more. They are preferably added in amounts of about $10^{-9}$ to $10^{-3}$ mol per mol of silver halide although the exact amount may vary with a particular purpose. They may be introduced into grains either uniformly or locally, for example, at the grain surface or interior. Rhodium and/or iridium are often used for the purpose of enhancing hard gradation.

At the stage of forming silver halide grains, silver halide solvents may be used, for example, rhodanides, $NH_3$, organic thioether derivatives as described in JP-B 11386/1972, and sulfur-containing compounds as described in JP-A 144319/1978. Also, nitrogenous compounds may be added as described, for example, in JP-B 7781/1971 and JP-A 222842/1985 and 122935/1985.

Gelatin is a useful binder used as protective colloid in the preparation of the emulsion according to the invention although any other hydrophilic colloid may be used. Useful binders include gelatin derivatives, graft polymers of gelatin and other polymers, proteins such as albumin and casein, cellulose derivatives such as hydroxyethyl cellulose and cellulose sulfate, sodium alginate, starch derivatives, and a variety of synthetic hydrophilic polymers, for example, homopolymers and copolymers of polyvinyl alcohol, partially acetal modified polyvinyl alcohol, poly-N-vinylpyrrolidone, polyacrylic acid, polymethacrylic acid, polyacrylamide, polyvinyl imidazole, and polyvinyl pyrazole.

Examples of the gelatin used include lime treated gelatin, acid treated gelatin, and enzyme treated gelatin as described in Bull. Soc. Sci. Phot., Japan, No. 16, p. 30 (1966) as well as hydrolyzed and enzymatically decomposed products of gelatin.

For the remaining conditions, reference should be made to P. Glafkides, "Chemie et Physique Photographique", Paul Montel (1967), G. F. Duffin, "Photographic Emulsion Chemistry", Focal Press (1966), V. L, Zelikman et al., "Making and Coating Photographic Emulsion", Focal Press (1964). More particularly, acidic, neutral and ammonia methods may be used. The mode of reacting a soluble silver salt with a soluble halide may be single jet, double jet or a combination thereof. It is also employable to form grains in the presence of excess silver, which is known as reverse mixing method. One special type of the double jet technique is by maintaining constant the pAg of a liquid phase in which silver halide is created, which is known as a controlled double jet technique.

In preparing silver halide grains according to the present invention by adding a silver salt solution and a halide solution, grain growth can be accelerated by increasing the flow rate, amount and concentration of the solutions with time as described in U.S. Pat. No. 3,650,757 and JP-A 142329/1980 and 158124/1980.

During or after silver halide grain formation, the grain surface may be replaced with a halogen for forming substantially insoluble silver halide grains.

The reaction solution may be agitated by any well-known methods. No limits are imposed on the temperature and pH of the reaction solution during silver halide grain formation.

(4) Chemical sensitization

The silver halide emulsion used herein may be used without chemical sensitization although it is advantageous to chemically sensitize the emulsion for enhancing the sensitivity thereof. For chemical sensitization purpose, there may be employed sulfur sensitization, gold sensitization, reduction sensitization and a combination thereof. Any of these sensitization methods may be combined with chalcogenide sensitization using chalcogenides such as selenium and tellurium compounds or noble metal sensitization using palladium, iridium and similar noble metals.

Also preferably, inhibitors such as nitrogenous heterocyclic compounds as typified by 4-hydroxy-6-methyl-( 1,3,3*a*, 7)-tetraazaindene are added at the start, intermediate or end of chemical sensitization.

Preferred sulfur sensitizing agents are compounds containing sulfur capable of reacting with active gelatin or silver, for example, thiosulfates, allylthiocarbamide, thiourea, allylisothiacyanates, cystine, p-toluenethiosulfonates, rhodanides, and mercapto compounds. Also useful are those described in U.S. Pat. Nos. 1,574,944, 2,410,689, 2,278,947, 2,728,668 and 3,656,955.

In the practice of the invention, photosensitive silver halide is preferably coated in a weight of 1 mg to 10 grams calculated as silver per square meter of photosensitive material (1 mg/m$^2$ to 10 g/m$^2$).

In the practice of the invention, there are preferably used stabilizers of formula (4) which are known from JP-A 192242/1984 and 191032/1984.

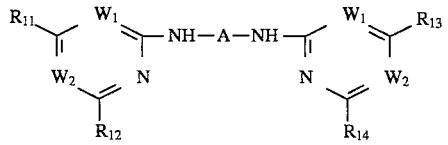

(4)

In the formula, A is a divalent aromatic residue. $R_{11}$, $R_{12}$, $R_{13}$ and $R_{14}$ are independently selected from the group consisting of a hydrogen atom, hydroxy radical, alkyl radical, alkoxy radical, aryloxy radical, halogen atom, heterocyclic nucleus, heterocyclylthio radical, alkylthio radical, arylthio radical, amino radical, substituted or unsubstituted alkylamino radical, substituted or unsubstituted arylamino radical, substituted or unsubstituted aralkylamino radical, aryl radical, and mercapto radical, with the proviso that at least one of A, $R_{11}$, $R_{12}$, $R_{13}$ and $R_{14}$ has a sulfo radical. $W_1$ and $W_2$ are independently —CH= or —N= with the proviso that either one of $W_1$ and $W_2$ is —N=.

More particularly, —A— in formula (4) represents a divalent aromatic residue which may contain a —$SO_3M$ radical wherein M is a hydrogen atom or a cation for imparting water solubility such as sodium and potassium. Useful —A— is selected from the following exemplary groups of —Al— and —A2—, with the proviso that —A— is selected from the group of —Al— where $R_{11}$, $R_{12}$, $R_{13}$ and $R_{14}$ are free of —$SO_3M$.

—$A_1$—;

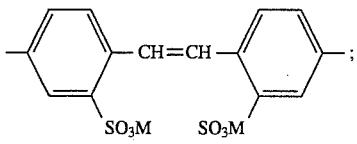

;

-continued

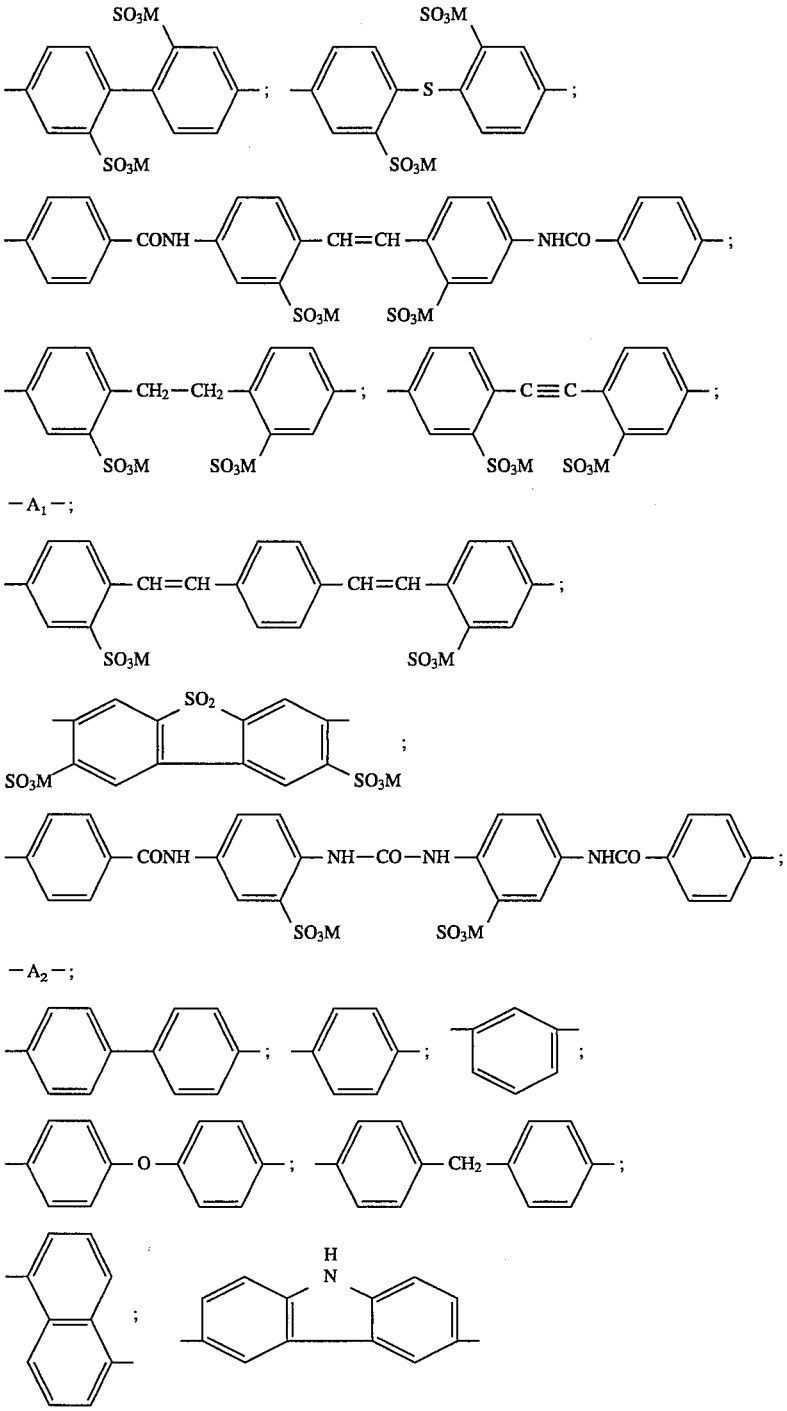

In the exemplary formulae of the —Al— group, M is a hydrogen atom or a cation for imparting water solubility.

In formula (4), the radicals represented by $R_{11}$, $R_{12}$, $R_{13}$ and $R_{14}$ are hydrogen atoms, hydroxy radicals, lower alkyl radicals preferably having 1 to 8 carbn atoms (e.g., methyl, ethyl, n-propyl and n-butyl), alkoxy radicals preferably having 1 to 8 carbn atoms (e.g., methoxy, ethoxy, propoxy and butoxy), aryloxy radicals (e.g., phenoxy, naphthoxy, o-tolyloxy and p-sulfophenoxy), halogen atoms (e.g., chlorine and bromine), heterocyclic nuclei (e.g., morpholino and piperidyl), heterocyclylthio radicals (e.g., benzothiazolylthio, benzimidazolylthio and phenyltetrazolylthio), alkylthio radicals (e.g., methylthio and ethylthio), arylthio radicals (e.g., phenylthio and tolylthio), amino radical, substituted or unsubstituted alkylamino radicals (e.g., methylamino, ethylamino, propylamino, dimethylamino, diethylamino, dodecylamino, cyclohexylamino, β-hydroxyethylamino, di-(β-hydroxyethyl)amino and β-sulfoethylamino), substituted or unsubstituted arylamino radicals (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino and sulfonaphthylamino), heterocyclylamino radicals (e.g., 2-benzothiazolylamino and 2-pyridylamino), substituted or unsubstituted aralkylamino radicals (e.g., benzylamino, o-anisylamino, m-anisylamino and p-anisylamino), aryl radicals (e.g., phenyl), and mercapto radicals. $R_{11}$, $R_{12}$, $R_{13}$ and $R_{14}$ may be identical or different. Where —A— is selected from the —A2— group, at least one of $R_{11}$, $R_{12}$, $R_{13}$ and $R_{14}$ should have at least one sulfo radical which may be a free acid radical or form a salt.

Each of $W_1$ and $W_2$ is —CH= or —N= with the proviso that either one of $W_1$ and $W_2$ is —N=.

Several illustrative, non-limiting examples of the compound of formula (4) are given below.

(A-1)
disodium 4,4'-bis[4,6-di(benzothiazolyl-2-thio)pyrimidin-2-ylamino] stilbene-2,2'-disulfonate (A-2)
disodium 4,4'-bis[4,6-di(benzothiazolyl-2-amino)pyrimidin-2-ylamino] stilbene-2,2'-disulfonate (A-3)
disodium 4,4'-bis[4,6-di(naphthyl-2-oxy)pyrimidin-2-ylamino] stilbene-2,2'-disulfonate (A-4)
disodium 4,4'-bis[4,6-di(naphthyl-2-oxy)pyrimidin-2-ylamino] bibenzyl-2,2'-disulfonate (A-5)
disodium 4,4'-bis(4,6-dianilinopyrimidin-2-ylamino)stilbene 2,2'-disulfonate (A-6)
disodium 4,4'-bis[4 -chloro-6-(2-naphthyloxy)pyrimidin-2-ylamino] biphenyl-2,2'-disulfonate (A-7)
disodium 4,4'-bis[4,6-di(1-phenyltetrazolyl-5-thio)- pyrimidin-2-ylamino]stilbene-2,2'-disulfonate (A-8) disodium 4,4'-bis[4,6-di(benzimidazolyl-2-thio)pyrimidin-2-ylamino] stilbene-2,2'-disulfonate (A-9)
disodium 4,4'-bis[4,6-diphenoxypyrimidin-2-ylamino]stilbene- 2,2'- disulfonate (A-10)
disodium 4,4'-bis[4,6-diphenylthiopyrimidin-2-ylamino]-stilbene 2,2'- disulfonate (A-11)
disodium 4,4'-bis[4,6 -dimercaptopyrimidin-2-ylamino]-biphenyl- 2,2'-disulfonate (A-12)
disodium 4,4'-bis(4,6-dianilino-triazin-2-ylamino)stilbene-2,2'-disulfonate (A-13)
disodium 4,4—bis(4-anilino-6-hydroxy-triazin-2-ylamino)-stilbene- 2,2'-disulfonate (A-14)
disodium 4,4'-bis (4-naphthylamino-6-anilino-triazin-2-ylamino) stilbene-2,2'-disulfonate (A-15)
4,4'-bis[2,6-di(2-naphthoxy)pyrimidin-4-ylamino]stilbene-2,2'-disulfonic acid (A-16)
disodium 4,4'-bis[2,6-di(2-naphthylamino)pyrimidin-4-ylamino] stilbene-2,2'-disulfonate (A-17)
disodium 4,4'-bis[2,6-dianilinopyrimidin-4-ylamino]stilbene- 2,2'-disulfonate (A-18)
4,4'-bis[2-(2-naphthylamino)-6-anilinopyrimidin-4-ylamino] stilbene-2,2'-disulfonic acid (A-19)
ditriethylammonium 4,4'-bis [2,6-diphenoxypyrimidin-4-ylamino] stilbene-2,2-disulfonate (A-20)
disodium 4,4'-bis[2,6- di(benzimidazolyl-2-thio)pyrimidin-4-ylamino] stilbene-2,2'-disulfonate The compounds of formula (4) are per se known or can be readily prepared by known methods.

In the present invention, the compounds of formula (4) are advantageously used in the silver halide emulsion in amounts of about 0.01 to 20 grams per mol of silver halide, especially about 1 to 10 grams per mol of silver halide.

Preferably, the infrared sensitizing dyes and the compound of formula (4) are used in a weight ratio of from about 1/1 to 1/500, especially from about 1/2 to 1/200.

The compounds of formula (4) may be directly dispersed in the emulsion or dissolved in a suitable solvent such as methyl alcohol, ethyl alcohol, methyl cellosolve and water or a mixture thereof prior to addition to the emulsion. Alternatively, the compounds can be added to the emulsion in the form of a solution or a dispersion in colloid as are the sensitizing dyes. Also the compounds can be dispersed and added to the emulsion by the method described in JP-A 80119/1975.

Heat-developable photosensitive material

The present invention is advantageously applied to heat-developable color photosensitive material, which will be described below.

In the heat-developable color photosensitive material to which the invention is applicable, filter dyes can be used. Although all filter dyes having dye moieties known in the art are considered useful, the present invention favors those filter dyes having an oil-soluble residue known as a ballast in order to prevent the dyes from transferring to image-receiving materials during processing. The favorable dyes include cyanine dyes and azomethine, indoaniline, indophenol, azine, amidrazone and azo dyes described in T. H. James, the Theory of the Photographic Process, 4th Ed., Macmillan, 1977, pp. 194–233 and 335–362, which are ballasted prior to use.

Particularly when exposure is made using write-in heads based on light emitting diodes (LED) and semiconductor lasers, filter dyes are often used for providing color separation in the infrared (IR) region. Then a choice is made of those dyes having an absorption maximum wavelength ($\lambda$max) of 700 nm or longer. Exemplary such infrared dyes are described in Functional Material, June 1990, pp. 64.

The filter dyes are incorporated into photosensitive material by any of well-known methods including solid dispersion and emulsion dispersion methods. If another substance is to be incorporated in the same layer by a solid dispersion or emulsion dispersion method, it is recommended for manufacturing cost reduction to disperse the dye at the same time by the same method.

In the heat-developable photosensitive material of the invention, an organic metal salt may be used as an oxidizing agent along with the photosensitive silver halide. Organic silver salts are preferred among these organic metal salts. Useful examples of the organic compounds which can be used to form the organic silver salt oxidizing agents are benzotriazoles, fatty acids and other compounds as described in U.S. Pat. No. 4,500,626, columns 52-53. Also useful are silver salts of carboxylic acids having an alkynyl radical such as silver phenylpropiolate as described in JP-A 113235/1985 and silver acetylene as described in JP-A 249044/1986. A mixture of two or more organic silver salts may be used.

The organic silver salt is used in an amount of from about 0.01 to about 10 mol, preferably from about 0.01 to about 1 mol per mol of photosensitive silver halide. The combined amount of the photosensitive silver halide and organic silver salt coated preferably ranges from about 50 mg to about 10 grams of silver per square meter.

In the practice of the present invention, various antifoggants or photographic stabilizers may be used. Examples are azoles and azaindenes as described in RD 17643 (1978), pages 24–25, nitrogenous carboxylic acids and phosphoric acids as described in JP-A 168442/1984, mercapto compounds and metal salts thereof as described in JP-A 111636/1984, and acetylene compounds as described in JP-A 87957/1987. The antifoggants are used in a total amount of from about $1\times10^{-7}$ to about 10 mol, preferably from about $1\times10^{-4}$ to about 1 mol, more preferably about $1\times10^{-3}$ to $2\times10^{-1}$ mol per mol of photosensitive silver halide.

The binders employed in layers of the photosensitive material and dye-fixing material are preferably hydrophilic. Typical examples are described in JP-A 253159/1987, pages 26–28. More particularly, one preferred binder is a transparent or translucent hydrophilic binder, examples of which include natural substances, for example, proteins such as gelatin and gelatin derivatives, cellulose derivatives, and polysaccharides such as starch, glum arabic, dextran, pluran, etc.; and synthetic polymers such as polyvinyl alcohol, polyvinyl pyrrolidone, acrylamide polymer, etc. Other examples of the synthetic polymer are polymers having a high water-absorbing capacity as described in JP-A 45260/1987, that is, homopolymers of vinyl monomers having —COOM or —$SO_3M$ wherein M is hydrogen or an alkali metal or copolymers of such vinyl monomers or copolymers of such a vinyl monomer with another vinyl monomer, for example, sodium methacrylate, ammonium methacrylate, and Sumikagel L- 5H manufactured and sold by Sumitomo Chemical K.K. of Japan. The binders may be used alone or in admixture of two or more.

Particularly in a system of carrying out heat development in the presence of a small amount of water, the use of a highly water-absorbing polymer as mentioned above enables rapid water absorption. The highly water-absorbing polymer, when used in a dye-fixing layer or a protective layer therefor, is also effective in preventing the once transferred dye from being re-transferred from the dye-fixing element to another layer.

The binders may be coated in amounts of up to about 20 grams per square meter, preferably up to about 10 grams per square meter, and most preferably up to about 7 grams per square meter of photosensitive material.

A variety of polymer latexes may be contained in layers (including a back layer) of the photosensitive material or dye-fixing element for the purposes of improving film physical properties, for example, increasing dimensional stability and preventing curling, adhesion, film crazing, pressure sensitization or desensitization. Useful examples are the polymer latexes described in JP-A 245258/1987, 136648/1987, and 110066/1987. Particularly, addition of a polymer latex having a low glass transition temperature of up to 40° C. to a mordant layer is useful in preventing the mordant layer from crazing. Addition of a polymer latex having a high glass transition temperature to a back layer is useful in preventing curling.

There may be used any of the reducing agents which are known in the field of heat-developable color photosensitive materials. Also included are dye providing substances having reducing nature as will be described later (in this case, another reducing agent may be additionally used). Also useful are reducing agent precursors which themselves have no reducing nature, but exert reducing nature under the action of nucleophilic reagents or heat during development step.

Examples of the reducing agent and precursor are described in the following patents.

| | | |
|---|---|---|
| U.S. Pat. No. 4,500,626, col. 49–50, | | |
| U.S. Pat. No. 4,483,914, col. 30–31, | | |
| U.S. Pat. No. 4,330,617 and 4,950,152 | | |
| JP-A 140335/1985 | 40245/1982 | 138736/1981 |
| 178458/1984 | 53831/1984 | 182449/1984 |
| 182450/1984 | 119555/1985 | 128436/1985 |
| 128437/1985 | 128438/1985 | 128439/1985 |
| 198540/1985 | 181742/1985 | 259253/1986 |
| 244044/1987 | 131253/1987 | 131254/1987 |
| 131255/1987 | 131256/1987 | |
| EP 220746 A2 | | |

Also useful are combinations of reducing agents as disclosed in U.S. Pat. No. 3,039,869.

Where a non-diffusible reducing agent is used, an electron transfer agent and/or an electron transfer agent precursor may be used for promoting electron transfer between the non-diffusible reducing agent and developable silver halide, if desired. The electron transfer agents and precursors thereof may be selected from the above-mentioned reducing agents and precursors thereof. The electron transfer agent or precursors thereof should preferably have greater mobility than the non-diffusible reducing agent (electron donor). Useful electron transfer agents are 1-phenyl- 3-pyrazolidones and aminophenols.

The non-diffusible reducing agent (electron donor) which is combined with the electron transfer agent may be selected from those of the above-mentioned reducing agents which are substantially immobile in a layer of photosensitive material, preferably hydroquinones, sulfonamidophenols, sulfonamidonaphthols, and the compounds described as the electron donor in JP-A 110827/1978, and dye providing substances having non-diffusion and reducing properties to be described later. The reducing agent is generally added in an amount of 0.01 to 20 mol, preferably 0.1 to 10 mol per mol of silver.

In the photosensitive material of the present invention, there may be contained a compound which, when silver ion is reduced into silver at elevated temperatures, produces or releases a mobile or diffusible dye in direct or inverse proportion to the reaction. These compounds are simply referred to as dye-providing compounds or substances.

Typical of the dye-providing substance are compounds capable of forming dyes through oxidative coupling reaction, which are known as couplers. The couplers may be either four or two-equivalent couplers. Useful are two-equivalent couplers having a non-diffusible group as a splittable group and capable of forming a diffusible dye through oxidative coupling reaction. The non-diffusible group may form a polymeric chain. Illustrative examples of the color developing agents and couplers are described in, for example, T. H. James, "The Theory of the Photographic Process", 4th Ed., pp. 291–334 and 354–361, and the following Japanese laid-open specifications.

| | | |
|---|---|---|
| JP-A 123533/1983 | 149046/1983 | 149047/1983 |
| 111148/1984 | 124399/1984 | 174835/1984 |
| 231539/1984 | 231540/1984 | 2950/1985 |
| 2951/1985 | 14242/1985 | 23474/1985 |
| 66249/1985 | | |

Another class of dye-providing compounds includes compounds having the function of releasing or diffusing a diffusible dye imagewise. The compounds of this type may be represented by the following formula [L I]:

[L I] $(Dye-Y)_n-Z$ wherein Dye represents a dye group, a temporarily wavelength shortened dye group or a dye precursor group; Y represents a valence bond or a connecting linkage; and Z represents a group which, in correspondence or counter-correspondence to photosensitive silver salt having a latent image distributed imagewise, produces a difference in diffusibility of the compound represented by $(Dye-Y)_n-Z$ or releases Dye, the diffusibility of Dye released being different from that of the compound represented by $(Dye-Y)_n-Z$; and n represents an integer of 1 or 2, when n=2, the Dye–Y's may be the same or different.

Illustrative examples of the dye providing compound of formula [L I] are given below as classes (1) to (5). It is to be noted that the compounds of classes (1) to (3) are those forming a diffusible dye image (positive dye image) in counter proportion to the development of silver halide and the compounds of classes (4) to (5) are those forming a diffusible dye image (negative dye image) in proportion to the development of silver halide.

Class (1): Dye developing reagents in the form of a hydroquinone-type developing reagent having a dye moiety attached thereto are disclosed in U.S. Pat. No. 3,134,764; 3,362,819; 3,597,200; 3,544,545; and 3,482,972. These dye developing reagents are diffusible in an alkaline environment and become non-diffusible upon reaction with silver halide.

Class (2): Non-diffusible compounds which release diffusible dyes in an alkaline environment, but lose the ability upon reaction with silver halide are described in U.S. Pat. No. 4,503,137. Examples are substances which release a diffusible dye through intramolecular nucleophilic substitution reaction as disclosed in U.S. Pat. No. 3,980,479, and substances which release a diffusible dye through intramolecular rewind reaction of an isooxazolone ring as disclosed in U.S. Pat. No. 4,199,354.

Class (3) includes compounds which release a diffusible dye through reaction with the reducing agent which has left non-oxidized by development as disclosed in U.S. Pat. Nos. 4,559,290 and 4,783,396, EP 220746 A2, and Technical Report 87-6199.

Examples are compounds which release a diffusible dye through intramolecular nucleophilic substitution reaction after reduction as disclosed in U.S. Pat. Nos. 4,139,389 and 4,139,379, JP-A 185333/1984 and 84453/1982; compounds which release a diffusible dye through intramolecular electron transfer reaction after reduction as disclosed in U.S. Pat. No. 4,232,107, JP-A 101649/1984 and 88257/1986, Research Disclosure 24025 (1984); compounds which release a diffusible dye through cleavage of a single bond after reduction as disclosed in German Patent 30 08 588A, JP-A 142530/1981, U.S. Pat. Nos. 4,343,893 and 4,619,884; nitro compounds which release a diffusible dye upon receipt of an electron as disclosed in U.S. Pat. No. 4,450,223; and compounds which release a diffusible dye upon receipt of an electron as disclosed in U.S. Pat. No. 4,609,610.

Preferred examples are compounds having a N-X bond wherein X is an oxygen, sulfur or nitrogen atom and an electron attractive group in a molecule as disclosed in EP 220746 A2, Technical Report 87-6199, U.S. Pat. No. 4,783,396, JP-A 201653/1988 and 201654/1988; compounds having a $SO_2$—X bond wherein X is as defined above and an electron attractive group in a molecule as disclosed in Japanese Patent Application No. 106885/1987; compounds having a PO—X bond wherein X is as defined above and an electron attractive group in a molecule as disclosed in JP-A 271344/1988; and compounds having a C—X' bond wherein X' is the same as X or —SO2— and an electron attractive group in a molecule as disclosed in JP-A 271341/1988. Also useful are compounds which release a diffusible dye through cleavage of a single bond after reduction due to π-bond conjugated with an electron accepting group as disclosed in JP-A 161237/1989 and 161342/1989.

More preferred are the compounds having a N—X bond and an electron attractive group in a molecule, with examples being described in EP 220746 A2 or U.S. Pat. No. 4,783,396 as compounds (1)–(3), (7)–(10), (12), (13), (15), (23)–(26), (31), (32), (35), (40), (41), (44), (53)–(59), (64), and (70) and in Technical Report 87-6199 as compounds (11) to (23).

Class (4) includes couplers having a diffusible dye as an eliminatable group and thus releasing a diffusible dye through reaction with an oxidant of a reducing agent, known as DDR couplers, as described in British Patent No. 1,330,524, JP-B 39165/1973; U.S. Pat. No. 3,443,940, 4,474,867 and 4,483,914.

Class (5) includes compounds (DRR couplers) which themselves have reducing nature to silver halide or organic silver salts and release a diffusible dye upon reduction of the silver halide or organic silver salts. Without a need for an extra reducing agent, the DRR couplers eliminate the serious problem that an image can be contaminated with oxidation decomposition products of a reducing agent. Typical examples are described in the following patents:

| | | |
|---|---|---|
| U.S. Pat. No. 3,443,939 | 3,725,062 | 3,728,113 |
| 3,928,312 | 4,053,312 | 4,055,428 |
| 4,336,322 | 4,500,626 | |
| JP-A 65839/1984 | 69839/1984 | 116537/1983 |
| 179840/1982 | 3819/1978 | 104343/1976 |

as well as Research Disclosure 17465. Examples of the DRR compound are described in U.S. Pat. No. 4,500,626, columns 22–44, with preferred ones being identified as compounds (1)–(3), (10)–( 13), (16)–(19), (28)–(30), (33)–(35), (38)–(40), and (42)–( 64). Also useful are those described in U.S. Pat. No. 4,639,408, columns 37–39.

There are available dye providing compounds other than the aforementioned couplers and compounds of formula [L I]. Such additional dye-providing compounds include dye-silver compounds in which an organic silver salt is combined with a dye (see Research Disclosure, May 1978, pages 54–58); azo dyes useful in heat development silver dye bleaching process (see U.S. Pat. No. 4,235,957 and Research Disclosure, April 1976, pages 30–32); and leuco dyes (see U.S. Pat. No. 3,985,565 and 4,022,617).

The dye-providing compound may be incorporated into an emulsion layer or a non-sensitive layer adjacent thereto or both.

Hydrophobic additives like dye-providing compounds and non-diffusible reducing agents may be introduced into a layer of photosensitive material by any desired method, for example, by the method described in U.S. Pat. No. 2,322,027. Use may be made of high-boiling organic solvents as described in JP-A 83154/1984, 178451/1984, 178452/1984, 178453/1984, 178454/1984, 178455/1984, and 178457/1984, optionally in combination with low-boiling organic solvents having a boiling point of 50° to 160° C. The amount of the high-boiling organic solvent used is generally up to 10 grams, preferably up to 5 grams per gram of the dye-providing compound and up to 1 cc, preferably up to 0.5 cc, more preferably up to 0.3 cc per gram of the binder.

A dispersion method using a polymer as disclosed in JP-B 39853/1976 and JP-A 59943/1976 may be used.

Substantially water-insoluble compounds may be dispersed in a binder as fine particles although any of the aforementioned addition methods may be used.

In dispersing hydrophobic compounds in hydrophilic colloids, a variety of surfactants may be used. Exemplary surfactants are found in JP-A 157636/1984, pages 37–38.

The photosensitive material according to the invention may further contain a compound capable of activating development and stabilizing an image at the same time. Examples are found in U.S. Pat. No. 4,500,626, columns 51–52.

It is preferred to remove the low-boiling organic solvent from the gelatin dispersion of the dye-providing compound by vacuum distillation or through a ultrafiltration membrane because the resultant emulsion coating solution is improved in shelf stability.

In the system of forming images through diffusion transfer of dyes, a photosensitive material is used in combination with a dye fixing material or element. There are generally two typical forms, one form having photosensitive material and dye-fixing material separately applied on two separate supports and another form having both photosensitive material and dye-fixing material applied on a common support. With respect to the relation of the photosensitive material and the dye-fixing material to one another, to the support, and to a white reflective layer, reference may be made to U.S. Pat. No. 4,500,626, col. 57.

The dye-fixing material preferably used in the present invention has at least one layer containing a mordant and a binder. The mordant may be selected from those known in the photographic art, for example, the mordants described in U.S. Pat. No. 4,500,626, col. 58–59 and JP-A 88256/1986, pages 32–41; and the compounds described in JP-A 244043/1987 and 244036/1987. Also useful are dye accepting polymers as disclosed in U.S. Pat. No. 4,463,079.

If desired, the dye-fixing material may be provided with any auxiliary layer, for example, a protective layer, peeling layer, and anti-curling layer, in addition to the above-mentioned layers. Provision of a protective layer is especially effective.

One or more layers of the photosensitive material and dye-fixing material may contain a plasticizer, a lubricant, or a high-boiling organic solvent as an agent for facilitating stripping of the photosensitive material from the dye-fixing material. Examples are found in JP-A 253159/1987 and 245253/1987.

Moreover, various silicone fluids may be used for the same purpose as above. The silicone fluids include dimethylsilicone fluid and modified silicone fluids of dimethylsiloxane having organic radicals incorporated therein. Examples are the modified silicone fluids described in "Modified Silicone Oil Technical Data", Shin-Etsu Silicone K. K., pages 16–18B, especially carboxy-modified silicone (trade name X-22-3710). Also useful are the silicone fluids described in JP-A 215953/1987 and 46449/1988.

Various anti-fading agents may be used in the photosensitive material and dye-fixing material according to the invention. Exemplary anti-fading agents are antioxidants, UV absorbers and certain metal complexes. The antioxidants include chromans, coumarans, phenols (e.g., hindered phenols), hydroquinone derivatives, hindered amine derivatives, and spiroindanes. Also useful are the compounds described in JP-A 159644/1986. The UV absorbers include benzotriazoles (see U.S. Pat. No. 3,533,794, etc.), 4-thiazolidones (see U.S. Pat. No. 3,352,681, etc.), benzophenones (see JP-A 2784/1971, etc.), and the compounds described in JP-A 48535/1979, 136641/1987, and 88256/1986. Also useful are the compounds described in JP-A 260152/1987. Useful metal complexes are described in U.S. Pat. No. 4,241,155, U.S. Pat. No. 4,245,018, col. 3–36, U.S. Pat. No. 4,254,195, col. 3-8, JP-A 174741/1987, 88256/1986, pages 27–29, 199248/1988, and Japanese Patent Application Nos. 234103/1987 and 230595/1987. Other useful anti-fading agents are described in JP-A 215272/1987, pages 125–137.

For preventing the dye transferred to the dye-fixing material from fading, the anti-fading agent may be previously contained in the dye-fixing material or supplied to the dye-fixing material from the exterior, typically photosensitive material.

The above-mentioned antioxidants, UV absorbers and metal complexes may be used in combination.

Fluorescent brighteners may be used in the photosensitive material and dye-fixing material. Preferably, the brightener is incorporated in the dye-fixing material or supplied thereto from the exterior such as the photosensitive material. Exemplary brighteners are described in K. Veenkataraman, "The Chemistry of Synthetic Dyes", Vol. V, Chap. 8, and JP-A 143752/1986. Illustrative examples include stilbene compounds, coumarin compounds, biphenyl compounds, benzoxazolyl compounds, naphthalimide compounds, pyrazoline compounds, and carbostyryl compounds. The brightener may be combined with the anti-fading agent.

Hardeners are contained in photographic constituent layers of the photosensitive material and dye-fixing element. Examples of the hardener are described in U.S. Pat. No. 4,678,739, JP-A 116655/1984, 18942/1986 and 245261/1987, and include aldehyde hardeners such as formaldehyde; aziridine hardeners; epoxy hardeners; vinylsulfone hardeners such as N,N'-ethylene-bis(vinylsulfonylacetamide)ethane; N-methylol hardeners such as dimethylol urea; and polymeric hardeners such as the compounds described in JP-A 234157/1987.

The photosensitive material and dye-fixing material may contain a surfactant in any layer thereof for various purposes including coating aid, stripping improvement, lubrication, antistatic, and development acceleration. Useful surfactants are found in JP-A 173463/1987 and 183457/1987.

Organic fluorine compounds may be contained in any layer of the photosensitive material and dye-fixing element for various purposes including lubrication, antistatic, and stripping improvement. Useful organic fluorine compounds are the fluoride surfactants described in JP-B 9053/1982, JP-A 20944/1986 and 135826/1987, and hydrophobic fluorine compounds including oily fluorine compounds such as fluoro-oil and solid fluorine compound resins such as tetrafluoroethylene resin.

Matte agents may be contained in any layer of the photosensitive material and dye-fixing material. Exemplary matte agents include silicon-dioxide, polyolefins, polymethacrylate and other compounds as described in JP-A 88256/1986, and beads of benzoguanamine resin, polycarbonate resin, AS resin or the like as described in JP-A 274944/1988 and 274952/1988.

The photosensitive material and dye-fixing material may contain thermal solvents, antifoaming agents, antifungal and antibacterial agents, colloidal silica or the like in any layer thereof. These additives are described in JP-A 8256/1986, pages 26–32.

Image formation promoters may also be used in the photosensitive material and/or dye-fixing material in the practice of the present invention. The image formation promoters have the functions of promoting such reactions as redox reaction of a silver salt-oxidizing agents with a reducing agent, formation of a dye from a dye-providing substance, decomposition of a dye or release of a mobile dye, and promoting transfer of a dye from a photosensitive material layer to a dye-fixing layer. From their physical-chemistry, they may be classified into bases, base precursors, nucleophilic compounds, high-boiling organic solvents (oils), thermal solvents, surfactants, and compounds capable of interacting with silver or silver ion. It should be noted that these compounds generally have multiple functions and thus possess some of the above-mentioned promoting effects combined. For further detail, reference is to be made to U.S. Pat. No. 4,678,739, col. 38–40.

Base precursors are preferably those precursors which undergo any reaction under heat to release a base, for example, organic acid-base salts which are decomposed or decarbonated upon heating, and compounds which are decomposed to release amines through intramolecular nucleophilic substituting reaction, Lossen rearrangement or Beckman rearrangement. Examples are found in U.S. Pat. No. 4,511,493 and JP-A 65038/1987.

In a system wherein heat development and dye transfer are simultaneously carried out in the presence of a minor amount of water, the base and/or base precursor may be contained in the dye-fixing material because the photosensitive material is then improved in shelf stability.

Additionally, combinations of a difficultly soluble metal compound and a compound capable of reaction with a metal ion of said difficultly soluble metal compound to form a complex (complexing compound) as described in EP-A 210,660 and U.S. Pat. No. 4,740,445 and compounds which generate bases through electrolysis as described in JP-A 232451/1986 may also be used as the base precursor. The former is particularly effective. Advantageously, the difficultly soluble metal compound and complexing compound are separately added to the photosensitive material and dye-fixing element.

The photosensitive material and/or dye-fixing material may contain a development stopper for the purpose of providing consistent images at all times despite of variations in temperature and time of development. The development stopper used herein is a compound which quickly neutralizes a base or reacts with a base to reduce the base concentration in the film for terminating development or a compound which interacts with silver or a silver salt for suppressing development, both after optimum development has been done. Useful are acid precursors which release acids upon heating, electrophilic compounds which undergo substitution reaction with coexisting bases upon heating, nitrogenous heterocyclic compounds, mercapto compounds and precursors thereof. For detail, reference is made to JP-A 253159/1987.

The support used in the heat-developable photosensitive material and dye-fixing material according to the present invention may be of any desired material which can withstand the processing temperature. Typical supports are sheets of paper and films of synthetic polymer. Examples include films of polyethylene terephthalate (PET), polycarbonate, polyvinyl chloride, polystyrene, polypropylene, polyimide, and celluloses (e.g., triacetyl cellulose), those films having incorporated therein pigments such as titanium oxide, synthetic paper formed from polypropylene or the like, mix paper machined from synthetic resin pulp such as polyethylene and natural pulp, Yankee paper, baryta paper, coated paper (cast coated paper), metals, fabrics, and glass. These supports may be used alone or supports laminated with synthetic polymers such as polyethylene on one or both surfaces thereof be used. Also useful are the supports described in JP-A 253159/1987, pages 29–31.

The support on the surface may be coated with a hydrophilic binder and an antistatic agent such as a semiconductor metal oxide (e.g., alumina sol and tin oxide) and carbon black.

The photosensitive material and/or dye-fixing element may have a conductive heater layer as means for producing heat necessary for heat development or dye diffusion transfer. Transparent or non-transparent heater elements as described in JP-A 145544/1986 may be used. These conductive layers also serve as antistatic layers.

In heat developing the heat-developable color photosensitive material according to the invention, the heating temperature is about 50° C. to about 250° C., preferably about 80° C. to about 180° C. Dye diffusion transfer may be effected at the same time as heat development or after the completion of heat development. In the latter case, the heating temperature in the transfer step may be from room temperature to the temperature used in the heat development, preferably from about 50° C. to a temperature about 10° C. lower than the heat development temperature.

Dye transfer can be induced solely by heat although a solvent may be used for promoting dye transfer. It is also useful to heat in the presence of a minor amount of solvent (especially water) to carry out development and transfer simultaneously or sequentially as disclosed in JP-A 218443/1984 and 238056/1986. In this mode, the heating temperature is from 50° C. to below the boiling point of the solvent, for example, from 50° C. to 100° C. if the solvent is water.

Examples of the solvent which is used in order to promote development and/or allow the diffusible dye to migrate to the dye-fixing layer include water and basic aqueous solutions containing inorganic alkali metal salts and organic bases (which may be those previously described for the image formation promoter). Also, low-boiling solvents and mixtures of a low-boiling solvent and water or a basic aqueous solution are useful. Surfactants, antifoggants, difficultly soluble metal salts and complexing compounds or the like may be contained in the solvents.

The solvent is used by applying it to the dye-fixing material or photosensitive material or both. The amount of the solvent used may be as small as below the weight of solvent corresponding to the maximum swollen volume of entire coatings, especially below the weight of solvent corresponding to the maximum swollen volume of entire coatings minus the dry weight of entire coatings.

Useful for applying the solvent to the photosensitive layer or dye-fixing layer is a method as disclosed in JP-A 147244/1986, page 26. It is also possible to seal the solvent in microcapsules and incorporate the microcapsules in the photosensitive material or dye-fixing material or both.

To promote dye transfer, a hydrophilic thermal solvent which is solid at room temperature, but melts at high temperature may be incorporated into the photosensitive material or dye-fixing material or both. The layer into which the thermal solvent is incorporated is not limited and may be selected from emulsion layers, intermediate layer, protective layer and dye-fixing layer. Preferably, the thermal solvent is incorporated into the dye-fixing layer and/or layers contiguous thereto. Examples of the hydrophilic thermal solvent include ureas, pyridines, amides, sulfonamides, imides, alcohols, oximes, and heterocyclics. To promote dye transfer, a high-boiling organic solvent may be incorporated into the photosensitive material or dye-fixing material or both.

Heating required in the development and/or transfer step may be carried out by any desired means, for example, by contacting with heated blocks or plates, contacting with hot plates, hot presses, hot rollers, halide lamp heaters, infrared or far infrared lamp heaters, or by passing through a hot atmosphere.

Pressure is applied in overlapping a photosensitive element and a dye-fixing element in close contact. Such pressure requirements and pressure application are described in JP-A 147244/1986, page 27.

For processing photographic elements according to the present invention, there may be used any of various developing apparatus including those described in JP-A 75247/1984, 177547/1984, 181353/1984 and 18951/1985 and Japanese U.M. Application Kokai No. 25944/1987.

Conventional photosensitive material

The present invention is also advantageously applicable to conventional color photosensitive material subject to conventional color development.

The color photosensitive material used herein may contain various chemicals for the purposes of improving image sharpness and the like. For example, dyes which can be discolored through processing, typically oxonol dyes as described in EP 337490 A2, pages 27–76 are added to a hydrophilic colloid layer of photosensitive material such that the optical reflective density of the photosensitive material at 680 nm may be at least 0.70. Also, titanium oxide surface treated with dihydric to tetrahydric alcohols, typically trimethylol ethane may be contained in a water-resistant resin layer of the support in an amount of at least 12% by weight, preferably at least 14% by weight. Cyanine dyes are also preferred. It is preferred to incorporate dyes in the photosensitive material by dispersing them in solid state fine particulate form.

High-boiling organic solvents are used in combination with photographic additives such as cyan, magenta and yellow couplers. Preferred solvents are immiscible with water, have a melting point below 100° C. and a boiling point above 140° C. and are good solvents for couplers. More preferably, the solvents should have a melting point below 80° C. and a boiling point above 160° C., especially above 170° C. For the high-boiling organic solvents, reference is made to JP-A 215272/1987, pages 137–144.

Also, the cyan, magenta and yellow couplers may be used by impregnating loadable latex polymers (see U.S. Pat. No. 4,203,716) with the couplers in the presence or absence of the high-boiling organic solvent or by dissolving the couplers in water-insoluble, organic solvent-soluble polymers and emulsifying and dispersing the solution in a hydrophilic colloid aqueous solution. Preferably, the homopolymers and copolymers described in WO 88/00723 are used. The use of methacrylate and acrylamide polymers, especially acrylamide polymers is recommended for color image stability.

In the color photosensitive material, compounds for improving color image storability as described in EP 277589 A2 are preferably used together with the aforementioned couplers, especially pyrazoloazole couplers. Useful are a compound (F) which chemically bonds with the aromatic amine color developing agent which is retained after color development, thereby forming a chemically inert, substantially colorless compound and a compound (G) which chemically bonds with the oxidant of aromatic amine color developing agent which is retained after color development, thereby forming a chemically inert, substantially colorless compound. Compounds (F) and (G) may be used alone or in admixture for preventing stain generation or other side effects due to a color developing dye formed by reaction of the coupler with a residual color developing agent or oxidant thereof retained in the film during shelf storage after processing.

In the color photosensitive material, anti-bacterial agents as described in JP-A 571247/1988 are preferably added for preventing fungi and bacteria from growing in the hydrophilic colloid layer to deteriorate the image.

The support used in the color photosensitive material according to the present invention may be a white polyester base support or a support having a white pigment-containing layer on the same side as the silver halide emulsion layers for display purposes. For improvement sharpness, the support is preferably coated with an anti-halation layer on the same side as or on the opposite side to the silver halide emulsion layers. The support preferably has a transmission density of 0.35 to 0.8 so that the display can be viewed with either reflecting or transmitting light.

After exposure, the color photosensitive material is subject to color development which is preferably followed by bleach-fixation for rapid processing purposes. Particularly when a high silver chloride emulsion is used, the bleach-fixing solution is preferably at about pH 6.5 or lower, more preferably at about pH 6 or lower for facilitating desilvering and other purposes.

With respect to the silver halide emulsion, other substances (such as additives) and photographic constituent layers (including layer arrangement) applied to the color photosensitive material used in the present invention and a method for processing the photosensitive material and processing chemicals used therein, reference is made to the patents described in the following Reference List, especially EP 03 55 660 A2 (JP-A 139544/1990).

Reference List

| Photographic constituent layer | JP-A 215272/1987 | JP-A 33144/1990 | EP 0,355,660 A2 |
|---|---|---|---|
| Silver halide solvent | P12/LL/L6-14<br>P13/LU/L18-P18/LL/L20 | — | — |
| Emulsion stabilizer<br>Development promoter | P39/LU/L1-P72/RU/L20<br>P72/LL/L1-P91/RU/L3 | P30/LU/L14-RU/L1 | P47/L16-19 |
| Color coupler<br>(cyan, magenta and yellow coupler) | P91/RU/L4-P121/LU/L6 | P3/RU/L14-P18/LU/L20<br>P30/RU/L6-P35/RL/L11 | P4/L15-27<br>P5/L30-P28/L20<br>P45/L29-31<br>P47/L23-P63/L50 |
| Color development augmenter | P121/LU/L7-P125/RU/L1 | — | — |
| UV absorber | P125/RU/L2-P127/LL/L20 | P37/RL/L14-P38/LU/L11 | P65/L22-31 |
| Anti-fading agent<br>(image stabilizer) | P127/RL/L1-P137/LL/L8 | P36/RU/L12-P37/LU/L19 | P4/L30-P5/L23<br>P29/L1-P45/L25 |

-continued

| Photographic constituent layer | Reference List JP-A 215272/1987 | JP-A 33144/1990 | EP 0,355,660 A2 |
|---|---|---|---|
| | | | P45/L33-40<br>P65/L2-21 |
| High and/or low boiling organic solvent | P137/LL/L9-P144/RU/L20 | P35/RL/L14-P36/LU/L17 | P64/L1-51 |
| Dispersion method of photographic additives | P144/LL/L1-P146/RU/L7 | P27/RL/L10-P28/LU/L20<br>P35/RL/L12-P36/RU/L7 | P63/L51-P64/L56 |
| Hardener | P146/RU/L8-P155/LL/L4 | — | — |
| Developing agent precursor | P155/LL/L5-RL/L2 | — | — |
| DIR | P155/RL/L3-9 | — | — |
| Support | P155/RL/L19-P156/LU/L14 | P38/RU/L18-P39/LU/L3 | P66/L29-P67/L13 |
| Photosensitive layer arrangement | P156/LU/L15-RL/L14 | P28/RU/L1-15 | P45/L41-52 |
| Dye | P156/RL/L15-P184/RL/L20 | P38/LU/L12-RU/L7 | P66/L18-22 |
| Color mixing inhibitor | P185/LU/L1-P188/RL/L3 | P36/RU/L8-11 | P64/L57-P65/L1 |
| Gradation modifier | P188/RL/L4-8 | — | — |
| Anti-staining agent | P188/RL/L9-P193/RL/L10 | P37/LU/L20-RL/L13 | P65/L32-P66/L17 |
| Surfactant | P201/LL/L1-P210/RU/L20 | P18/RU/L1-P24/RL/L20<br>P27/LL/L11-RL/L9 | — |
| Fluorinated compound (as antistatic agent, coating aid, lubricant, anti-sticking agent, etc.) | P210/LL/L1-P222/LL/L5 | P25/LU/L1-P27/RL/L9 | — |
| Binder | P222/LL/L6-P225/LU/L20 | P38/RU/L8-18 | P66/L23-28 |
| Thickener | P225/RU/L1-P227/RU/L2 | — | — |
| Antistatic agent | P227/RU/L3-P230/LU/L1 | — | — |
| Polymer latex | P230/LU/L2-P239/RL/L20 | — | — |
| Matte agent | P240/LU/L1-P240/RU/L20 | — | — |
| Photographic processing method (processing steps and additives) | P3/RU/L7-P10/RU/L5 | P39/LU/L4-P42/LU/L20 | P67/L14-P69/L28 |

Note:
(1) Abbreviations are: P is page, LU is left upper column, RU is right upper column, LL is left lower column, RL is right lower column, and L is line. For example, P10/RU/L6 means page 10, right upper column, line 6.
(2) JP-A 215272/1987 cited herein includes the amendment dated March 16, 1987.

Useful cyan couplers include the diphenylimidazole cyan couplers described in JP-A 33144/1990, the 3-hydroxypyridine cyan couplers described in EP 333185 A2, typically coupler (42) which is a four equivalent coupler converted to a two equivalent form by attaching a chlorine coupling-off group, and couplers (6) and (9), and the cyclic active methylene cyan couplers described in JP-A 32260/1989, typically exemplary couplers 3, 8 and 34.

For processing a silver halide color photosensitive material using a high silver chloride emulsion having a silver chloride content of higher than 90 mol %, the method described in JP-A 207250, pages 27–34 is preferably applied.

Moreover, the present invention is applicable to a black-and-white photosensitive material which is subject to conventional black-and-white development. In this regard, reference is made to Japanese Patent Application No. 33221/1991, 77193/1991 and 29892/1992.

For exposing the photosensitive material imagewise to record images therein, a variety of exposure methods are employable. For example, exposure may be done by directly taking pictures of objects (inclusive of portraits and scenes) using a camera or the like; exposing through a reversal film or negative film using a printer, enlarger or the like; scanning an original and exposing through a slit using an exposure unit of a duplicating machine; actuating a light emitting diode, laser or the like to emit light for exposure in response to electrical signals representative of image information; or outputting image information on a display such as a CRT, liquid crystal display, electroluminescent display and plasma display and exposing directly or through an optical system.

A variety of light sources may be used for recording images in photosensitive material, for example, sunlight, tungsten lamps, light emitting diodes, laser light sources, CRT light sources and the like as described in U.S. Pat. No. 4,500,625, col. 56.

Also acceptable is imagewise exposure using a wavelength conversion element having a non-linear optical material combined with a coherent light source such as a laser. The non-linear optical material used herein is that material which when an intense photoelectric field as provided by laser light is applied, can develop polarization in non-linear relationship with the electric field. Examples include inorganic compounds such as lithium niobate, potassium dihydrogen phosphate (KDP), lithium iodate and $BaB_2O_4$; urea derivatives and nitroaniline derivatives, for example, nitropyridine-N-oxide derivatives such as 3-methyl-4-nitropyridine-N-oxide (POM); and the compounds described in JP-A 53462/1986 and 210432/1987. The wavelength conversion elements include single crystal optical waveguide and fiber types which are both applicable.

The image information may be given in the form of image signals available from video cameras and electronic still cameras, television signals as represented by NTSC, image signals obtained by dividing an original into a multiplicity of pixels by means of a scanner, and image signals created by means of computers as represented by CG and CAD.

EXAMPLE

Examples of the present invention are given below by way of illustration and not by way of limitation.

Example 1

This example is representative of an exemplary heat-developable color photosensitive material.

Emulsion (1) was prepared as follows.

To a thoroughly agitated gelatin aqueous solution having the composition shown in Table 1, Liquids I and II shown in Table 2 were concurrently added over 18 minutes. After 5 minutes from the completion of addition, Liquids III and IV shown in Table 2 were concurrently added over 42 minutes. The emulsion was desalted by adding flocculant (P-1) previously shown in the specification and washing with water. After 22 grams of gelatin was added to the emulsion at pH 4.1, an aqueous solution of NaCl and NaOH was added to the emulsion to adjust it to pH 6.1 and pAg 7.6 at 40° C. for re-dispersion. Using trimethylthiourea and 4-hydroxy-6-methyl-( 1,3,3*a*,7)-tetraazaindene, the emulsion was chemically sensitized optimum at 60° C. The optimum implies the conditions under which maximum sensitivity is achieved without a fog. There was obtained 635 grams of a monodisperse emulsion having a mean grain size of 0.26 μm and a coefficient of variation of 8.5%.

TABLE 1

| Gelatin aqueous solution composition | |
|---|---|
| $H_2O$ | 620 cc |
| Gelatin | 20 g |
| KBr | 0.03 g |
| NaCl | 2.00 g |
| $H_2SO_4$ (1N) | 16 cc |
| 1,3-dimethylimidazolidine-2-thion | 0.015 g |
| pH = 3.9 | |
| Temperature = 45° C. | |

Below is the structure of 1,3-dimethylimidazolidine-2thion.

TABLE 2

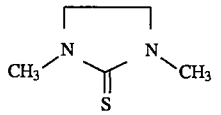

Formula(A)

| Liquid | I | II | III | IV |
|---|---|---|---|---|
| $AgNO_3$ | 30.0 g | — | 70.0 g | — |
| KBr | — | 13.7 g | — | 44.1 g |
| NaCl | — | 3.6 g | — | 2.4 g |
| $K_2IrCl_6$ | — | — | — | $4.0 \times 10^{-5}$ |
| Water (totaling to) | 150 cc | 150 cc | 350 cc | 350 cc |

Emulsion (2) was prepared by the same procedure as emulsion (1) except that chemical sensitization with trimethylthiourea and 4-hydroxy-6-methyl-(1,3,3*a*,7)-tetraazaindene was effected-at 70° C. and thereafter, sensitizing dye (DI-1) previously shown in the specification was added to the sensitized emulsion, which was agitated for minutes. The amount of dye added was 0.28 grams per mol of silver.

Emulsion (3) was prepared by the same procedure as emulsion (1) except that 80 ml of a 0.5% aqueous solution of sensitizing dye (1) shown later was all added at the end of addition of Liquids I and II, the flocculant (P-1) was replaced by flocculant (P-2) previously shown in the specification, and the trimethylthiourea sulfur sensitizer was replaced by sodium thiosulfate. There was obtained 635 grams of a monodisperse emulsion of nearly rectangular somewhat deformed cubic grains having a mean grain size of 0.31 μn and a coefficient of variation of 10.2%.

Next described is how to prepare gelatin dispersions of dye-providing substances. The chemical compounds used are shown later.

To 70 ml of ethyl acetate were added 14.64 grams of a magenta dye-providing substance (A) , 0.21 grams of a reducing agent (1), 0.20 grams of a mercapto compound (1), 0.38 grams of a surfactant (3), and 5.1 grams of a high-boiling organic solvent (2). The mixture was heated to about 60° C. to form a uniform solution. This solution was mixed with 100 grams of 10% lime-treated gelatin solution and 60 ml of water. The mixture was agitated for dispersion by a homogenizer at 10,000 rpm for 10 minutes. This dispersion is designated a magenta dye-providing substance dispersion.

To 50 ml of ethyl acetate were added 7.3 grams of a cyan dye-providing substance (B1), 10.6 grams of a cyan dye-providing substance (B2), 1.0 grams of a reducing agent (1), 0.3 grams of a mercapto compound (1), 0.38 grams of a surfactant (3), and 9.8 grams of a high-boiling organic solvent (1). The mixture was heated to about 60° C. to form a uniform solution. This solution was mixed with 100 grams of 10% lime-treated gelatin solution and 60 ml of water. The mixture was agitated for dispersion by a homogenizer at 10,000 rpm for 10 minutes. This dispersion is designated a cyan dye-providing substance dispersion.

To 45 ml of ethyl acetate were added 18.75 grams of a yellow dye-providing substance (C) , 1.0 grams of a reducing agent (1), 0.12 grams of a mercapto compound (1), 1.5 grams of a surfactant (3), 7.5 grams of a high-boiling organic solvent (1), and 2.1 grams of a dye (F). The mixture was heated to about 60° C. to form a uniform solution. This solution was mixed with 100 grams of 10% lime-treated gelatin solution and 60 ml of water. The mixture was agitated for dispersion by a homogenizer at 10,000 rpm for 10 minutes. This dispersion is designated a yellow dye-providing substance dispersion.

Using the above-prepared components, a heat developable color photosensitive material No. 100 of the following formulation was prepared. It is to be noted that for the first emulsion layer, the sensitizing dye was added at the time of preparing a coating solution; for the third emulsion layer, the sensitizing dye was added during chemical sensitization; and for the fifth emulsion layer, the sensitizing dye was added during grain formation. The amounts of these dyes were optimized to achieve the highest sensitivity. It will be understood that No. 100 was prepared as a reference sample which is outside the scope of the invention.

Formulation of photosensitive material No. 100

| Ingredient | Amount (g/m²) |
|---|---|
| 7th layer: protective layer | |
| Gelatin | 0.264 |
| Matte agent | 0.018 |
| $Zn(OH)_2$ | 0.964 |
| Surfactant (1) | 0.028 |
| Surfactant (2) | 0.011 |
| Water-soluble polymer (1) | 0.004 |
| 6th layer: intermediate layer | |
| Gelatin | 0.762 |
| Surfactant (1) | 0.007 |
| Surfactant (2) | 0.022 |
| Water-soluble polymer (1) | 0.016 |
| 5th layer: red (670 nm) sensitive layer | |
| Emulsion (3) | 0.321 (Ag) |
| 4-hydroxy-6-methyl-(1,3,3a,7)-tetraazaindene | 0.00193 |
| Sensitizing dye (1) | 0.0013 |
| Magenta dye-providing substance (A) | 0.2845 |
| High-boiling organic solvent (2) | 0.100 |

Formulation of photosensitive material No. 100

| Ingredient | Amount (g/m$^2$) |
|---|---|
| Reducing agent (1) | 0.004 |
| Mercapto compound (1) | 0.004 |
| Surfactant (3) | 0.007 |
| Gelatin | 0.297 |
| Antifoggant (1) | 0.003 |
| Water-soluble polymer (1) | 0.007 |
| Mercapto compound (3) | 0.00044 |
| 4th layer: intermediate layer | |
| Hardener | 0.058 |
| Gelatin | 0.629 |
| Surfactant (1) | 0.009 |
| Surfactant (4) | 0.046 |
| Water-soluble polymer (1) | 0.012 |
| 3rd layer: near infrared (750 nm) sensitive layer | |
| Emulsion (2) | 0.320 (Ag) |
| 4-hydroxy-6-methyl-(1,3,3a,7)-tetraazaindene | 0.00352 |
| Sensitizing dye (DI-1) | $5.8 \times 10^{-4}$ |
| Cyan dye-providing substance (B1) | 0.132 |
| Cyan dye-providing substance (B2) | 0.193 |
| High-boiling organic solvent (1) | 0.178 |
| Reducing agent (2) | 0.018 |
| Mercapto compound (1) | 0.005 |
| Surfactant (3) | 0.007 |
| Gelatin | 0.284 |
| Mercapto compound (2) | 0.003 |
| Stabilizer (1) | 0.0129 |
| Water-soluble polymer (1) | 0.010 |

Formulation of photosensitive material No. 100

| Ingredient | Amount (g/m$^2$) |
|---|---|
| 2nd layer: intermediate layer | |
| Gelatin | 0.629 |
| Surfactant (1) | 0.006 |
| Surfactant (4) | 0.057 |
| Water-soluble polymer (1) | 0.009 |
| 1st layer: infrared (810 nm) sensitive layer | |
| Emulsion (1) | 0.340 (Ag) |
| 4-hydroxy-6-methyl-(1,3,3a,7)-tetraazaindene | 0.00153 |
| Mercapto compound (2) | $8.4 \times 10^{-4}$ |
| Sensitizing dye (2) | $1.1 \times 10^{-4}$ |
| Yellow dye-providing substance (C) | 0.429 |
| Dye (F) | 0.049 |
| High-boiling organic solvent (1) | 0.172 |
| Reducing agent (1) | 0.023 |
| Mercapto compound (1) | 0.003 |
| Surfactant (3) | 0.034 |
| Gelatin | 0.338 |
| Stabilizer (1) | 0.0054 |
| Water-soluble polymer (1) | 0.014 |
| Support | |
| Polyethylene-laminated neutral paper, 120 μm thick | |

All the compounds used in preparing the dye-providing substance dispersions and the photosensitive material are shown below.

Magenta dye-providing substance (A):

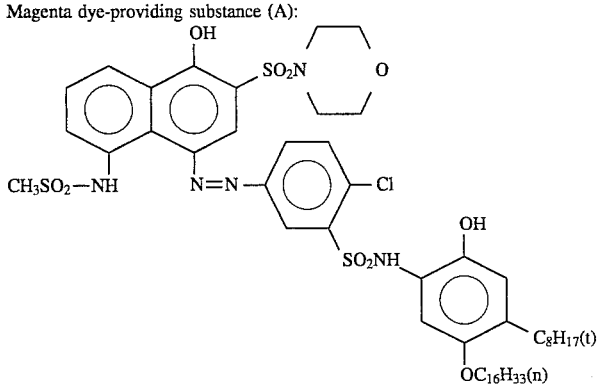

Cyan dye-providing substance (B1):

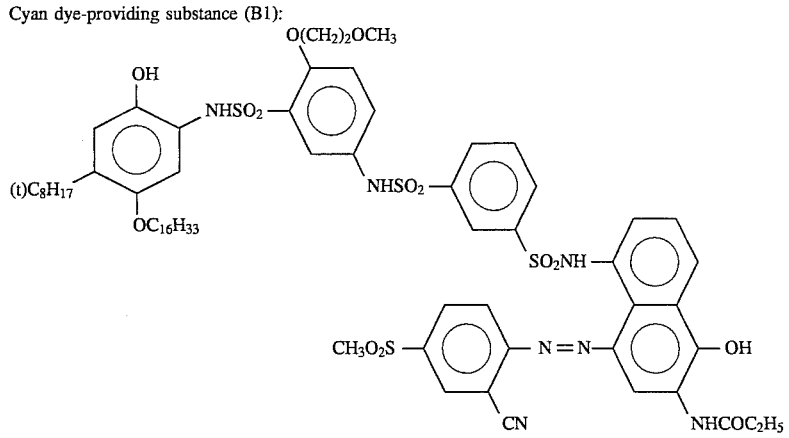

-continued
Cyan dye-providing substance (B2):
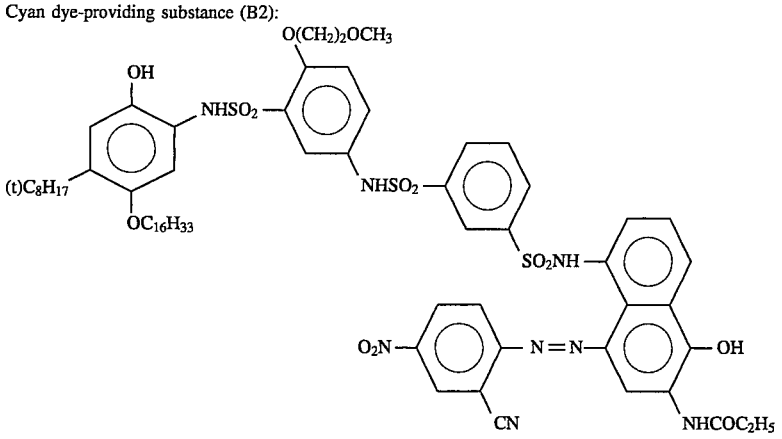
Yellow dye-providing substance (C):
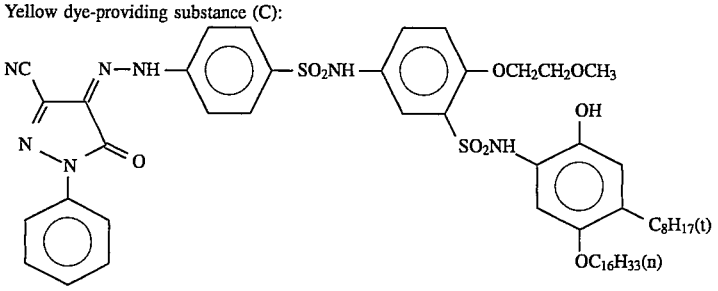
Reducing agent (1):
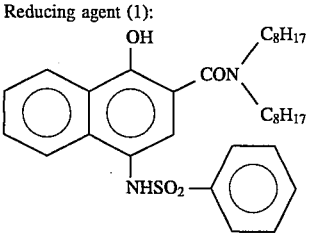
Mercapto compound (1):
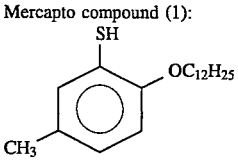
Surfactant (1): Aerosol OT
Surfactant (2):
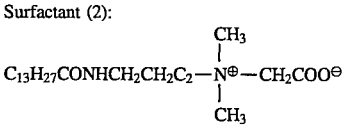
Surfactant (3):
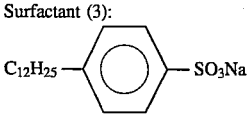
Surfactant (4):
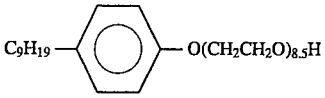

-continued
Dye (F):
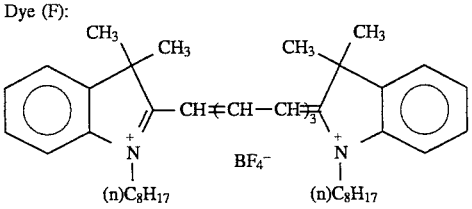
Mercapto compound (2):
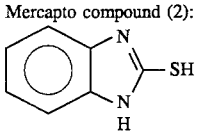
Mercapto compound (3):
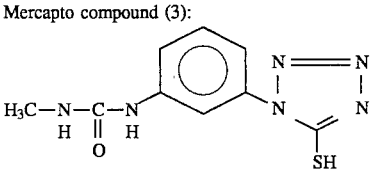
Hardener:
$CH_2{=}CHSO_2CH_2CONH(CH_2)_2NHCOCH_2SO_2CH{=}CH_2$
Stabilizer:
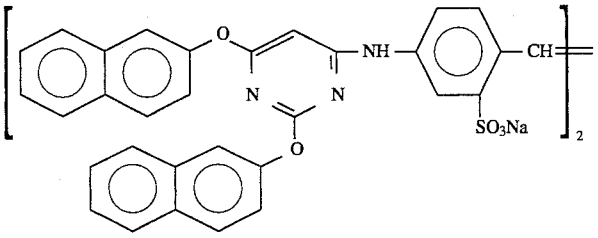
Sensitizing dye (1):
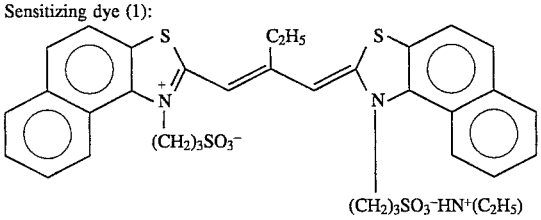
Sensitizing dye (2):
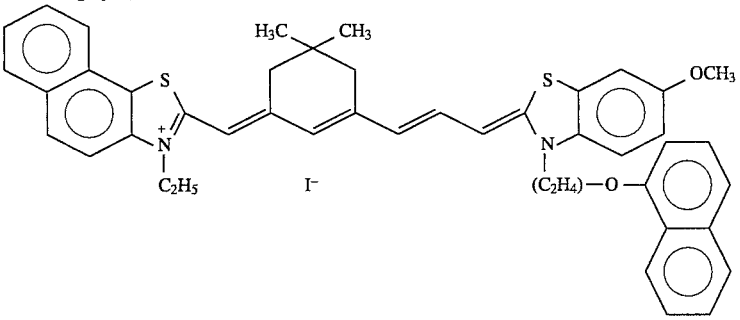
Water-soluble polymer (1)
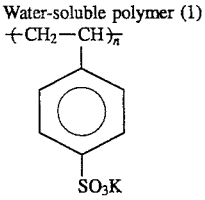

High-boiling organic solvent (1): triisononyl phosphate

High-boiling organic solvent (2): tricyclohexyl phosphate

Antifoggant (1): benzotriazole

For comparison purposes, photosensitive material sample Nos. 101 to 103 were prepared. Photosensitive material No. 101 was prepared by the same procedure as No. 100 except that the sensitizing dye (DI-1) was replaced by dye (DI-9) in the emulsion of the third layer.

Photosensitive material No. 102 was prepared by the same procedure as No. 100 except that the sensitizing dye (DI-1) was replaced by dye (DII-1) in the emulsion of the third layer.

Photosensitive material No. 103 was prepared by the same procedure as No. 100 except that the sensitizing dye (DI-1) was replaced by dye (DII-7) in the emulsion of the third layer.

The following photosensitive material samples are within the scope of the invention.

Photosensitive material No. 104 was prepared by the same procedure as No. 100 except that the sensitizing dye (DI-1) was replaced by a mixture of dyes (DI-1) and (DII-1) in a weight ratio of 4/1 in the emulsion of the third layer. Photosensitive material No. 105 was prepared by the same procedure as No. 100 except that the sensitizing dye (DI-1) was replaced by a mixture of dyes (DI-1) and (DII-1) in a weight ratio of 2/1 in the emulsion of the third layer.

Photosensitive material No. 106 was prepared by the same procedure as No. 100 except that the sensitizing dye (DI-1) was replaced by a mixture of dyes (DI-9) and (DII-7) in a weight ratio of 2/1 in the emulsion of the third layer.

Photosensitive material No. 107 was prepared by the same procedure as No. 100 except that the sensitizing dye (DI-1) was replaced by a mixture of dyes (DI-9) and (DII-1) in a weight ratio of 2/1 in the emulsion of the third layer.

Next, the preparation of a dye fixing material is described. A dye fixing material was prepared by coating a polyethylene-laminated paper support in accordance with the following formulation.

Formulation of dye fixing material

| Ingredient | Amount (g/m²) |
|---|---|
| 3rd layer: | |
| Gelatin | 0.05 |
| Silicone oil *1 | 0.04 |
| Surfactant *2 | 0.001 |
| Surfactant *3 | 0.02 |
| Surfactant *4 | 0.10 |
| Guanidine picolate | 0.45 |
| Polymer *5 | 0.24 |
| 2nd layer: | |
| Mordant *6 | 2.35 |
| Polymer *7 | 0.60 |
| Gelatin | 1.40 |
| Polymer *5 | 0.21 |
| High-boiling organic solvent *8 | 1.40 |
| Guanidine picolate | 1.80 |
| Surfactant *2 | 0.02 |
| 1st layer: | |
| Gelatin | 0.45 |
| Surfactant *4 | 0.01 |
| Polymer *5 | 0.04 |
| Hardener *9 | 0.30 |
| Support | |

-continued

Formulation of dye fixing material

| Ingredient | Amount (g/m²) |
|---|---|
| Polyethylene-laminated paper, 170 μm thick | |
| Back 1st layer: | |
| Gelatin | 3.25 |
| Hardener *9 | 0.25 |
| Back 2nd layer: | |
| Gelatin | 0.44 |
| Silicone oil *1 | 0.08 |
| Surfactant *2 | 0.002 |
| Matte agent *10 | 0.09 |
| Surfactant *11 | 0.01 |

The compounds used in the dye fixing material are identified below.

Silicone oil *1

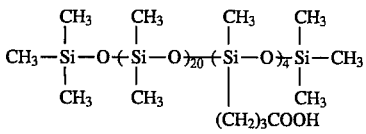

Surfactant *2

Aerosol OT

Surfactant *3

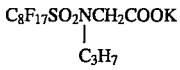

Surfactant *4

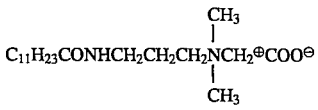

Polymer *5 vinyl alcohol-sodium acrylate copolymer (75/25 molar ratio)

Mordant *6

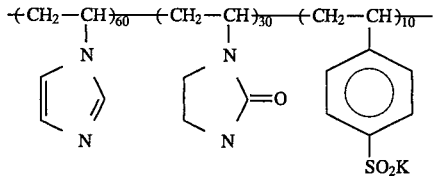

Polymer *7 dextran (molecular weight 70,000)

High-boiling organic solvent *8

Leophos 95 (manufactured by Ajinomoto K.K.)

Hardener *9

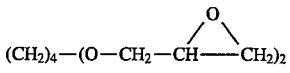

-continued

Matte agent *10 benzoguanamine resin containing 18 vol % of particles in excess of 10 μm

Surfactant *11

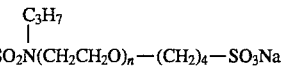

(n: ~4)

logE=logE1−logE2. More negative values indicate better color separation.

In accordance with the above-defined procedures, photosensitive material Nos. 100 to 107 were measured for the wavelength of maximum spectral sensitivity, sensitivity, fog, and degree of color separation of the cyan color generating layer. The results are shown in Table 3. Sensitivity is expressed in relative sensitivity based on a sensitivity of 100 for photosensitive material No. 100.

TABLE 3

| Photo-sensitive material | Sensitizing dye Designation | Sensitizing dye Weight ratio | Wavelength of maximum spectral sensitivity | Sensitivity | Fog | Color separation |
|---|---|---|---|---|---|---|
| 100* | DI-1 | | 750 | 100 | 0.2 | ≦−1.05* |
| 101* | DI-9 | | 753 | 112 | 0.12 | ≦−1.05* |
| 102* | DII-1 | | 736 | 55 | 0.12 | −0.5 |
| 103* | DII-7 | | 745 | 63 | 0.13 | −0.6 |
| 104 | DI-1 + DII-1 | 4/1 | 755 | 177 | 0.12 | ≦−1.05* |
| 105 | DI-1 + DII-1 | 2/1 | 760 | 317 | 0.12 | ≦−1.05* |
| 106 | DI-9 + DII-7 | 2/1 | 764 | 294 | 0.12 | ≦−1.05* |
| 107 | DI-9 + DII-1 | 2/1 | 762 | 286 | 0.12 | ≦−1.05* |

Since the emulsion of the third layer had low spectral sensitivity to light of 810 nm, only the upper limit was determined.

These photosensitive materials were evaluated by the following exposure and processing.

Using a laser exposure apparatus as described in Japanese Patent Application No. 129625/1990, each photosensitive material was exposed under the following conditions.

Exposure conditions

Beam intensity on photosensitive material surface: 1 mW

Scanning line density: 800 dpi (32 rasters/mm)

Beam diameter: 100±10 μm in main scanning direction 80±10 μm in subordinate scanning direction Exposure time: 0.9 msec./raster Exposure wavelength: 670, 760, 810 nm (laser light)

Exposure quantity: a variation of 1logE/2.5 cm in subordinate scanning direction (maximum 80 erg/cm$^2$, minimum 1.2 erg/cm$^2$)

Exposure quantity control: light emitting time modulation

After 12 cc/m$^2$ of water was supplied to the emulsion surface of the exposed photosensitive material by means of a wire bar, a dye fixing material was placed on the wet photosensitive material such that their effective surfaces contacted each other. Using a heating drum, the assembly was heated such that the water-absorbed coating reached a temperature of 90° C. for 20 seconds. The dye fixing material which now born an image thereon was then stripped from the photosensitive material. Spectral sensitivity was measured by exposing each photosensitive material to monochromatic light for 5 seconds through a wedge and thereafter carrying out the same procedures as above.

With respect to transfer density, fog and sensitivity (an inverse of the exposure providing a fog of +1.0) were measured using an auto-recording densitometer.

A degree of color separation was evaluated, after exposure at 810 nm, in terms of the difference between an exposure quantity logE1 providing a density of (Dmax−0.1) for yellow and an exposure quantity logE2 providing a density of (Dmin+0.1) for cyan amalgamated with yellow, that is, As seen from these data, the combination of a (DI) Group sensitizing dye and a (DII) group sensitizing dye is effective in achieving high sensitivity and a longer wavelength of maximum spectral sensitivity without detracting from color separation capability. The wavelength of maximum spectral sensitivity becomes longer as the proportion of (DII) group to (DI) Group sensitizing dye increases. This increase in the wavelength of maximum spectral sensitivity was quite unexpected.

Example 2

Comparative photosensitive material No. 108 was prepared by the same procedure as No. 100 except that the sensitizing dye (DI-1) was replaced by dye (DI-3) in the emulsion of the third layer.

Comparative photosensitive material No. 109 was prepared by the same procedure as No. 100 except that the sensitizing dye (DI-1) was replaced by dye (DII-5) in the emulsion of the third layer.

Inventive photosensitive material No. 110 was prepared by the same procedure as No. 100 except that the sensitizing dye (DI-1) was replaced by a mixture of sensitizing dyes (DI-3) and (DII-5) in a weight ratio of 2/1 in the emulsion of the third layer.

Inventive photosensitive material No. 111 was prepared by the same procedure as No. 100 except that the sensitizing dye (DI-1) was replaced by a mixture of sensitizing dyes (DI-1) and (DII-5) in a weight ratio of 2/1 in the emulsion of the third layer.

Comparative photosensitive material No. 112 was prepared by the same procedure as No. 100 except that the sensitizing dye (DI-1) was replaced by dye (DI-15) in the emulsion of the third layer.

Inventive photosensitive material No. 113 was prepared by the same procedure as No. 100 except that the sensitizing dye (DI-1) was replaced by a mixture of sensitizing dyes (DI-1) and (DI-15) in a weight ratio of 2/1 in the emulsion of the third layer.

Comparative photosensitive material No. 114 was prepared by the same procedure as No. 100 except that the sensitizing dye (DI-1) Was replaced by dye (DII-3) in the emulsion of the third layer.

Inventive photosensitive material No. 115 was prepared by the same procedure as No. 100 except that the sensitizing dye (DI-1) was replaced by a mixture of sensitizing dyes (DI-1) and (DII-3) in a weight ratio of 2/1 in the emulsion of the third layer.

Comparative photosensitive material No. 116 was prepared by the same procedure as No. 100 except that the sensitizing dye (DI-1) was replaced by dye (DII-20) in the emulsion of the third layer.

Inventive photosensitive material No. 117 was prepared by the same procedure as No. 100 except that the sensitizing dye (DI-1) was replaced by a mixture of sensitizing dyes (DII-1) and (DII-20) in a weight ratio of 2/1 in the emulsion of the third layer.

Photosensitive material Nos. 108 to 117 were measured for sensitivity and fog as in Example 1. The results are shown in Table 4 together with the results of Nos. 100 and 102.

TABLE 4

| Photo- | Sensitizing dye | | | |
|---|---|---|---|---|
| sensitive material | Designation | Weight ratio | Sensitivity | Fog |
| 100* | DI-1 | | 100 | 0.12 |
| 102* | DII-1 | | 55 | 0.12 |
| 108* | DI-3 | | 128 | 0.12 |
| 109* | DII-5 | | 72 | 0.12 |
| 110 | DI-3 + DII-5 | 2/1 | 265 | 0.12 |
| 111 | DI-I + DII-5 | 2/1 | 251 | 0.13 |
| 112* | DI-15 | | 83 | 0.12 |
| 113 | DI-I + DI-15 | 2/1 | 138 | 0.12 |
| 114* | DII-3 | | 17 | 0.11 |
| 115 | DI-I + DII-3 | 2/1 | 211 | 0.12 |
| 116* | DII-20 | | 64 | 0.12 |
| 117 | DII-1 + DII-20 | 2/1 | 92 | 0.12 |

As seen from Table 4, sensitivity can be increased by combining two J-band type sensitizing dyes of formula (1).

Example 3

Comparative photosensitive material No. 200 was prepared in accordance with sample (5-2) in Example 5 of JP-A 146428/1992 or U.S. Ser. No. 772,746 (filed Oct. 7, 1991) by the same applicant or assignee as the present invention. The only change was that in the emulsion of the third layer (infrared-sensitive magenta color generating layer) of sample (5-2), the sensitizing dye was replaced by sensitizing dye (DI-1).

Inventive photosensitive material No. 201 was prepared by the same procedure as No. 200 except that the sensitizing dye (DI-1) was replaced by a mixture of sensitizing dyes (DI-1) and (DII-1) in a weight ratio of 2/1 in the emulsion of the third layer.

These photosensitive material Nos. 200 and 201 were subjected to scanning gradation exposure by the exposure method in Example 5 of JP-A 146428/1992. After exposure, the photosensitive materials were subjected to color development with the processing solution used in Example 4 of JP-A 146428/1992.

The thus processed photosensitive material Nos. 200 and 201 were determined for the sensitivity and fog of the magenta color generating layer. The sensitivity and fog were determined by measuring the density of developed color using an auto-recording densitometer. The sensitivity is an inverse of the exposure providing a density equal to the fog +0.3 and expressed in relative sensitivity based on a sensitivity of 100 for photosensitive material No. 200. The results are shown in Table 5.

TABLE 5

| Photosensitive material | Sensitivity | Fog |
|---|---|---|
| 200 (comparison) | 100 | 0.10 |
| 201 (invention) | 196 | 0.10 |

It is seen that the photosensitive material within the scope of the invention provides high sensitivity while retaining good color separation.

Example 4

Preparation of emulsion

Emulsion A:

With stirring, an aqueous solution containing 0.13 mol of silver nitrate and an aqueous solution containing 0.04 mol of potassium bromide and 0.09 mol of sodium chloride were added to a gelatin aqueous solution containing sodium chloride and 1,8-dihydroxy-3,6-dithiaoctane at 45° C. over 12 minutes by a double jet method. Silver chlorobromide grains having a mean grain size of 0.15 μm and a silver chloride content of 70 mol % were formed for nucleation. Similarly an aqueous solution containing 0.87 mol of silver nitrate and an aqueous solution containing 0.26 mol of potassium bromide and 0.65 mol of sodium chloride were then added over 20 minutes by a double jet method. In accordance with a conventional procedure, the emulsion was subject to flocculation, washed with water, combined with 40 grams of gelatin, and adjusted to pH 6.5 and pAg 7.5. The emulsion was chemically sensitized by adding 5 mg of sodium thiosulfate and 8 mg of chloroauric acid per mol of silver and heating at 60° C. for 75 minutes. To the emulsion was added 150 mg of 1,3,3*a*,7-tetraazaindene as a stabilizer. Then 0.28 grams/mol Ag of sensitizing dye (DI-1) was added to the emulsion which was agitated for 30 minutes. There were obtained cubic silver chlorobromide grains having a silver chloride content of 70 mol%, a mean grain size of 0.28 μn and a coefficient of variation of 10%.

Emulsion B:

The procedure of emulsion A was repeated except that the sensitizing dye (DI-1) was replaced by a mixture of sensitizing dyes (DI-1) and (DII-1) in a weight ratio of 2/1. There were obtained cubic silver chlorobromide grains having a silver chloride content of 70 mol %, a mean grain size of 0.28 μn and a Coefficient of variation of 10%.

Preparation of coated sample

To emulsion A, 70 ml of a 0.5% methanol solution of disodium 4,4'-bis(4,6-dinaphthoxypyrimidin-2-ylamino)-stilbene- 2,2'-disulfonate and 90 ml of a 0.5% methanol solution of 2,5-dimethyl-3-allyl-benzothiazole iodide were added for supersensitization and stabilization.

To the emulsion were further added 100 mg/m$^2$ of hydroquinone, poly(ethyl acrylate) latex as a plasticizer in an amount of 25% by weight based on the gelatin binder, and 86.2 mg/m$^2$ of 2-bis(vinylsulfonylacetamide)ethane as a hardener. The emulsion coating solution was coated on a polyester support to a silver coverage of 3.7 g/m$^2$ and a gelatin coverage of 2.5 g/m$^2$.

A sample, designated photosensitive material No. 300, was completed by simultaneously coating upper and lower protective layers on the emulsion layer. The upper protective layer contained 0.6 g/m$^2$ of gelatin, 60 mg/m$^2$ of polymethyl methacrylate with a particle size of 3–4 μm as a matte agent, 70 mg/m$^2$ of colloidal silica with a particle size of 10–20 μm, 10 mg/m$^2$ of silicone oil, sodium dodecylbenzenesulfonate as a coating aid, and a fluorinated surfactant as shown below. The lower protective layer contained 0.7 g/m$^2$ of gelatin, 225 mg/m$^2$ of poly(ethyl acrylate) latex, 20 mg/m$^2$ of a first dye as shown below, 10 mg/m$^2$ of a second dye as shown below, and sodium dodecylbenzenesulfonate as a coating aid.

Fluorinated surfactant:

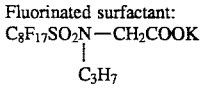

First dye:

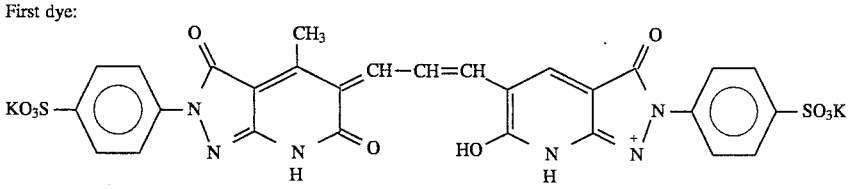

Second dye:

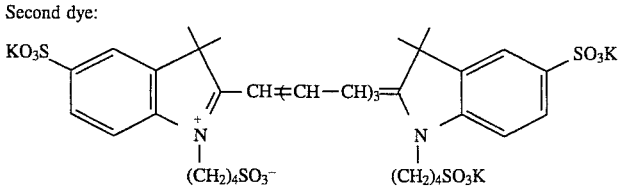

Photosensitive material No. 301 was prepared as No. 300 except that emulsion A was replaced by emulsion B.

The support used herein had a back layer and a back layer protecting layer of the following composition. The back layer had an expansion factor of 110%.

| Back layer | Amount (/m$^2$) |
|---|---|
| Gelatin | 3.0 g |
| Sodium dodecylbenzenesulfonate | 80 mg |
| Dye (a) | 80 mg |
| Dye (b) | 30 mg |
| Dye (c) | 100 mg |
| 1,3-divinylsulfonyl-2-propanol | 60 mg |
| Potassium polyvinylbenzenesulfonate | 30 g |
| **Back protective layer** | **Amount (/m$^2$)** |
| Gelatin | 0.75 g |
| Polymethyl methacrylate (size 4.7 μm) | 30 mg |
| Sodium dodecylbenzenesulfonate | 20 mg |
| Fluorinated surfactant shown above | 2 mg |
| Silicone oil | 100 mg |

Dye (a):

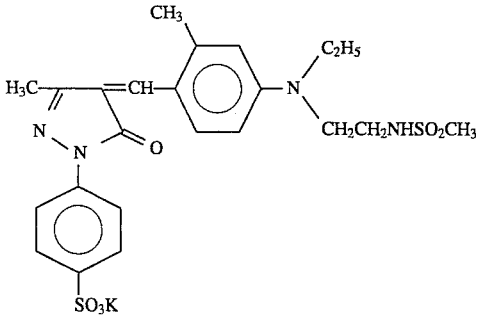

-continued

Dye (b)

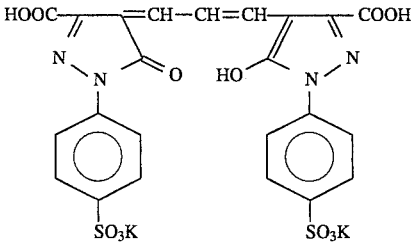

Dye (c)

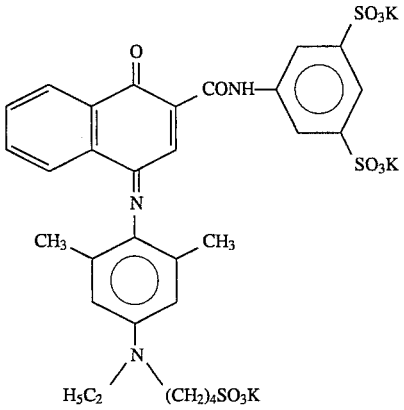

Evaluation of photographic properties

Photosensitive material Nos. 300 and 301 were exposed to a light beam from a semiconductor laser having a peak at 760 nm while varying the quantity of light at 1/10$^6$ second per pixel (100 μm$^2$). Using the following developer and fixer, the photosensitive material was processed through an automatic processor model FG-710NH (manufactured by Fuji Photo-Film Co., Ltd.) where it was subject to 38° C./15 sec. development, fixation, washing, and drying. Sensitometry was then carried out.

| Developer formulation | |
|---|---|
| Water | 720 ml |
| Disodium EDTA | 4 g |
| Sodium hydroxide | 44 g |
| Sodium sulfite | 45 g |
| 2-methylimidazole | 2 g |
| Sodium carbonate | 26.4 g |
| Boric acid | 1.6 g |
| Potassium bromide | 1 g |
| Hydroquinone | 20 g |
| Diethylene glycol | 39 g |
| 5-methyl-benzotriazole | 0.2 g |
| Pyrazone | 0.7 g |
| Water totaling to | 1 liter |
| **Fixer formulation** | |
| Ammonium thiosulfate | 170 g |
| Sodium sulfite (anhydrous) | 15 g |
| Nitric acid | 7 g |
| Glacial acetic acid | 15 ml |
| Potassium alum | 20 g |
| EDTA | 0.1 g |
| Tartaric acid | 3.5 g |
| Water totaling to | 1 liter |

The washing water used was city water.

Photosensitive material Nos. 300 and 301 were examined for sensitivity. The sensitivity is an inverse of the exposure providing a density of 3.0 and expressed in relative sensitivity based on a sensitivity of 100 for photosensitive material No. 300. The results are shown in Table 6.

TABLE 6

| Photosensitive material | Sensitivity |
|---|---|
| 300 (comparison) | 100 |
| 301 (invention) | 281 |

It is seen that the photosensitive material containing two J-band type sensitizing dyes within the scope of the invention provides higher sensitivity than the photosensitive material containing a single J-band type sensitizing dye.

There has been described a photosensitive material containing more than one J-band type sensitizing dye for increased sensitivity. Color separation is improved in the case of color photosensitive material.

Obviously many modifications and variations of the present invention are possible in the light of the above teachings. It is therefore to be understood that within the scope of the appended claims the invention may be practiced otherwise than as specifically described.

We claim:

1. A photographic silver halide material comprising at least one infrared sensitive silver halide emulsion layer containing a silver halide emulsion which is spectrally sensitized with a combination of at least two J-band type sensitizing dyes so as to have maximum spectral sensitivity at a wavelength of at least 700 nm;

wherein the combination of at least two J-band type sensitizing dyes is a combination of at least one compound of formula (DI);

wherein $R^1$ and $R^2$ each independently are $—C_2H_5$, $—C_2H_4OCH_3$, $—C_2H_4O(C_6H_{11})$ or $—(CH_2)_3SO_3$;

$R^5$ is —H, $—CH_3$ or $—C_2H_5$;

$V^1$ is a phenyl radical, a chlorophenyl radical, a naphthyl radical or a pyridine radical;

$X^1$ is —H, $—OCH_3$, $—OC_2H_5$ or —Cl;

$M^1$ is $I^-$, $Br^-$, $Na^+$, $ClO_4^-$, $NH(C_2H_5)$ or $CH_3(C_6H_{10})SO_3$; and $m^1$ is 0 or 1;

and at least one compound of formula (DII):

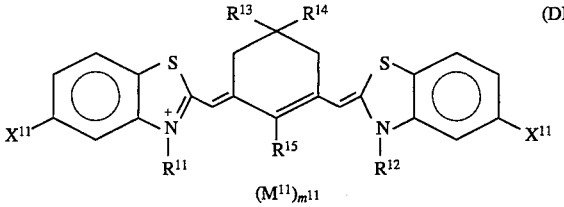

(DII)

wherein $R^{11}$ and $R^{12}$ each independently are $—C_2H_5$, $—C_2H_4OCH_3$, $—C_2H_4O(C_6H_{11})$ or $—(CH_2)_3SO_3^-$;

$R^{13}$ is —H or $—CH_3$;

$R^{14}$ is $—CH_3$, $—C_2H_5$ or a phenyl radical, provided that $R^{14}$ is $—CH_3$ or $—C_2H_5$ when $R^{13}$ is —H;

$R^{15}$ is —H , $—CH_3$, $—C_2H_5$ or a phenyl radical;

$X^{11}$ is —H, $—OCH_3$, $—OC_2H_5$ or —Cl;

$M^{11}$ is $Cl^-$, $Br^-$, $I^-$, $Na^+$, $ClO_4^-$, a p-toluene-sulfate ion, $NH(C_2H_5)_3^+$ or $CH_3(C_6H_{10})SO_3$; and $m^{11}$ is 0 or 1; and wherein the molar ratio of the compound of formula (DII) to the compound of formula (DI) is from 0.05 to 0.75.

2. The photographic silver halide material as claimed in claim 1, wherein the sensitizing dyes are contained in the silver halide emulsion in an amount from $0.5\times10^{-7}$ to $8\times10^{-3}$ mol per mol of silver halide.

3. The photographic silver halide material as claimed in claim 2, wherein the sensitizing dyes are contained in the silver halide emulsion in an amount from $1\times10^{-7}$ to $5\times10^{-3}$ mol per mol of silver halide.

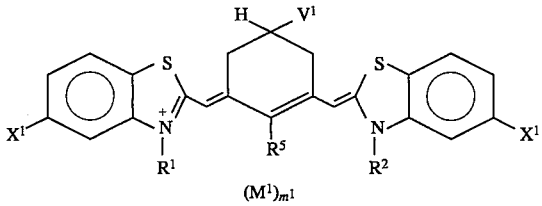

(DI)

4. The photographic silver halide material as claimed in claim 1, wherein the combination of J-band type sensitizing dyes is a combination represented by at least two compounds of formula (DI) and one compound of formula (DII); at least two compounds of formula (DII) and one compound of formula (DI); or at least two compounds of formula (DI) and at least two compounds of formula (DII).

* * * * *

UNITED STATES PATENT AND TRADEMARK OFFICE

CERTIFICATE OF CORRECTION

PATENT NO. : 5,508,161

DATED : April 16, 1996

INVENTOR(S) : Kiyoteru Miyake et al

It is certified that error appears in the above-identified patent and that said Letters Patent is hereby corrected as shown below:

Column 51, line 61, after "(DI):" insert therefor (DI)

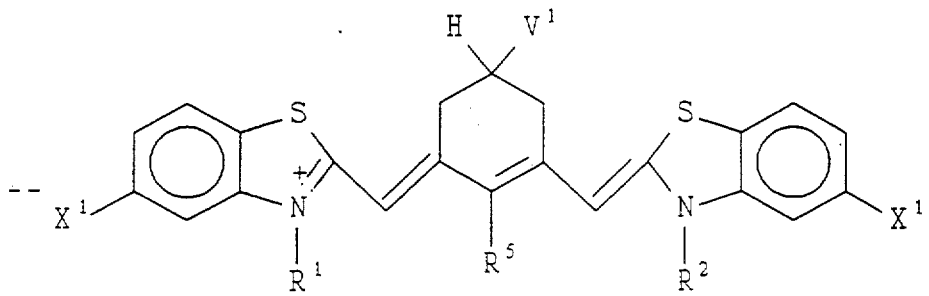

$(M^1)_{n1}$

UNITED STATES PATENT AND TRADEMARK OFFICE

CERTIFICATE OF CORRECTION

PATENT NO. : 5,508,161

DATED : April 16, 1996

INVENTOR(S) : Kiyoteru Miyake, et. al.

It is certified that error appears in the above-indentified patent and that said Letters Patent is hereby corrected as shown below:

Column 52, line 44, delete (DI)

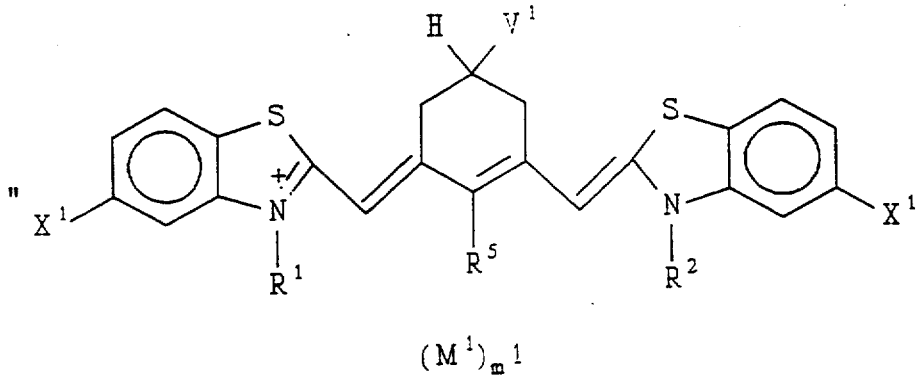

$(M^1)_{m^1}$

Signed and Sealed this

Thirtieth Day of July, 1996

Bruce Lehman

*Attest:*

BRUCE LEHMAN

*Attesting Officer*

*Commissioner of Patents and Trademarks*